US011515625B2

(12) United States Patent
Driscoll et al.

(10) Patent No.: US 11,515,625 B2
(45) Date of Patent: Nov. 29, 2022

(54) BEAM-STEERING ANTENNA

(71) Applicant: Echodyne Corp., Kirkland, WA (US)

(72) Inventors: Tom Driscoll, Bellevue, WA (US); Nathan Ingle Landy, Seattle, WA (US); Charles A. Renneberg, Seattle, WA (US); Ioannis Tzanidis, Woodinville, WA (US); Robert Tilman Worl, Issaquah, WA (US)

(73) Assignee: Echodyne Corp., Kirkland, WA (US)

( * ) Notice: Subject to any disclaimer, the term of this patent is extended or adjusted under 35 U.S.C. 154(b) by 139 days.

(21) Appl. No.: 16/159,567

(22) Filed: Oct. 12, 2018

(65) Prior Publication Data

US 2019/0115651 A1 Apr. 18, 2019

Related U.S. Application Data

(60) Provisional application No. 62/572,043, filed on Oct. 13, 2017.

(51) Int. Cl.
*H01Q 13/10* (2006.01)
*H01Q 1/38* (2006.01)
(Continued)

(52) U.S. Cl.
CPC ..... *H01Q 1/38* (2013.01); *H01P 1/264* (2013.01); *H01Q 1/28* (2013.01); *H01Q 1/3233* (2013.01);
(Continued)

(58) Field of Classification Search
CPC ..... H01Q 1/38; H01Q 21/005; H01Q 3/24; H01Q 13/20; H01Q 23/00; H01Q 25/00;
(Continued)

(56) References Cited

U.S. PATENT DOCUMENTS 2,981,949 A 4/1961 Elliott
4,410,891 A * 10/1983 Schaubert ..... H01Q 21/245 343/700 MS
(Continued)

FOREIGN PATENT DOCUMENTS

GB 2520920 A 6/2015
WO 2017078184 A1 5/2017
(Continued)

OTHER PUBLICATIONS

International Bureau, "International Preliminary Report on Patentability from PCT Application No. PCT/US2018/039600", from Foreign Counterpart to U.S. Appl. No. 16/019,371, dated Jan. 9, 2020, pp. 1-12, Published: WO.
(Continued)

*Primary Examiner* — Dieu Hien T Duong
(74) *Attorney, Agent, or Firm* — Volpe Koenig

(57) ABSTRACT

According to an embodiment, an antenna includes a conductive antenna element, a voltage-bias conductor, and a polarization-compensation conductor. The conductive antenna element is configured to radiate a first signal having a first polarization, and the voltage-bias conductor is coupled to a side of the antenna element and is configured to radiate a second signal having a second polarization that is different from the first polarization. And the polarization-compensating conductor is coupled to an opposite side of the antenna element and is configured to radiate third a signal having a third polarization that is approximately the same as the second polarization and that destructively interferes with the second signal. Such an antenna can be configured to reduce cross-polarization of the signals that its antenna elements radiate.

15 Claims, 16 Drawing Sheets

(51) Int. Cl.

| | |
|---|---|
| ***H01Q 21/00*** | (2006.01) |
| ***H01Q 3/24*** | (2006.01) |
| ***H01Q 13/20*** | (2006.01) |
| ***H01P 1/26*** | (2006.01) |
| ***H01Q 23/00*** | (2006.01) |
| ***H01Q 25/00*** | (2006.01) |
| ***H01Q 9/04*** | (2006.01) |
| ***H01Q 1/28*** | (2006.01) |
| ***H01Q 1/32*** | (2006.01) |
| ***H01Q 21/06*** | (2006.01) |
| ***H01Q 9/06*** | (2006.01) |

(52) U.S. Cl.
CPC ..... *H01Q 3/24* (2013.01); *H01Q 9/0442* (2013.01); *H01Q 9/0457* (2013.01); *H01Q 9/0478* (2013.01); *H01Q 9/065* (2013.01); *H01Q 13/106* (2013.01); *H01Q 13/20* (2013.01); *H01Q 21/005* (2013.01); *H01Q 21/0037* (2013.01); *H01Q 21/0043* (2013.01); *H01Q 21/065* (2013.01); *H01Q 23/00* (2013.01); *H01Q 25/00* (2013.01)

(58) Field of Classification Search
CPC ..... H01Q 9/0457; H01Q 9/0478; H01Q 1/28; H01Q 1/3233; H01Q 21/0037; H01Q 21/065; H01Q 9/0442; H01Q 9/065; H01Q 13/106; H01Q 21/0043; H01P 1/264
See application file for complete search history.

(56) References Cited

U.S. PATENT DOCUMENTS

| | | | | |
|---|---|---|---|---|
| 4,870,424 | A | 9/1989 | Lalezari et al. | |
| 5,781,157 | A | 7/1998 | Laird | |
| 7,081,851 | B1 | 7/2006 | Lewis | |
| 8,248,298 | B2 | 8/2012 | Lalezari | |
| 9,385,435 | B2 | 7/2016 | Bily et al. | |
| 9,450,310 | B2 | 9/2016 | Bily et al. | |
| 9,853,361 | B2 | 12/2017 | Chen et al. | |
| 9,869,762 | B1 | 1/2018 | Alland et al. | |
| 10,446,920 | B1 | 10/2019 | Meador et al. | |
| 2004/0227667 | A1 | 11/2004 | Sievenpiper | |
| 2006/0114155 | A1 | 6/2006 | Numminen et al. | |
| 2007/0132631 | A1 | 6/2007 | Henson et al. | |
| 2007/0279294 | A1* | 12/2007 | York | H01Q 21/065 343/700 MS |
| 2010/0141527 | A1 | 6/2010 | Lalezari | |
| 2011/0063158 | A1 | 3/2011 | Kondou et al. | |
| 2012/0068882 | A1 | 3/2012 | Blachford | |
| 2012/0139786 | A1 | 6/2012 | Puzella et al. | |
| 2012/0194399 | A1 | 8/2012 | Bily et al. | |
| 2014/0070994 | A1 | 3/2014 | Schmalenberg et al. | |
| 2014/0105054 | A1 | 4/2014 | Saegrov et al. | |
| 2014/0266919 | A1 | 9/2014 | Chen | |
| 2014/0266946 | A1 | 9/2014 | Bily et al. | |
| 2015/0109178 | A1 | 4/2015 | Hyde et al. | |
| 2015/0214615 | A1 | 7/2015 | Patel et al. | |
| 2015/0229032 | A1 | 8/2015 | Liu et al. | |
| 2015/0288063 | A1 | 10/2015 | Johnson et al. | |
| 2015/0318618 | A1 | 11/2015 | Chen et al. | |
| 2015/0355313 | A1 | 12/2015 | Li et al. | |
| 2015/0380828 | A1 | 12/2015 | Black et al. | |
| 2016/0011307 | A1 | 1/2016 | Casse et al. | |
| 2016/0099500 | A1 | 4/2016 | Kundlz et al. | |
| 2016/0372834 | A1 | 12/2016 | Bily et al. | |
| 2017/0061799 | A1 | 3/2017 | Fujii et al. | |
| 2017/0187123 | A1* | 6/2017 | Black | H01Q 21/06 |
| 2018/0026365 | A1 | 1/2018 | Driscoll et al. | |
| 2018/0040955 | A1* | 2/2018 | Vouvakis | H01Q 5/42 |
| 2018/0054004 | A1 | 2/2018 | Driscoll et al. | |
| 2018/0372837 | A1 | 12/2018 | Bily et al. | |
| 2019/0074600 | A1 | 3/2019 | Bily et al. | |
| 2020/0335859 | A1 | 10/2020 | Driscoll et al. | |

FOREIGN PATENT DOCUMENTS

| | | | |
|---|---|---|---|
| WO | 2019005870 | A1 | 1/2019 |
| WO | 2019172955 | A2 | 9/2019 |
| WO | 2020214933 | A1 | 10/2020 |

OTHER PUBLICATIONS

Hassanien et al., "Phased-MIMO Radar: A Tradeoff Between Phased-Array and MIMO Radars", Aug. 15, 2009, pp. 1-34.

International Searching Authority, "International Search Report and Written Opinion from PCT Application No. PCT/US2018/050090 dated Oct. 1, 2019", from Foreign Counterpart to U.S. Appl. No. 16/125,486, pp. 1-19, Published: WO.

U.S. Patent and Trademark Office, "Office Action", U.S. Appl. No. 16/019,371, dated May 26, 2020, pp. 1 through 77, Published: US.

Huang et al, "Chapter 11, Design and Modeling of Micorstrip Line to Substrate Integrated Waveguide Transitions", "Passive Micowave Components and Antennas", Apr. 1, 2010, pp. 1-24, "retrieved on Feb. 5, 2017 from: http://www.intechopen.com/books/passive-microwavecomponents-and-antennas/design-and-modeling-of-microstrip-line-to-substrate-integrated-waveguidetransitions", dated Apr. 1, 2010, pp. 225-246 and reference, Publisher: INTECH.

International Searching Authority, "International Search Report and Written Opinion from PCT Application No. PCT/US2017/043110 dated Nov. 2, 2017", from Foreign Counterpart to U.S. Appl. No. 15/655,505, pp. 1-15, Published: WO.

International Searching Authority, "International Search Report and Written Opinion from PCT Application No. PCT/US2017/046943 dated Oct. 26, 2017", from Foreign Counterpart to U.S. Appl. No. 15/240,980, pp. 1-20, Published: WO.

International Searching Authority, "International Search Report and Written Opinion from PCT Application No. PCT/US2018/055737 dated Apr. 18, 2019", from Foreign Counterpart to U.S. Appl. No. 16/159,567, pp. 1-25, Published: WO.

International Searching Authority, "Invitation to Pay Additional Fees from PCT Application No. PCT/US2018/055737 dated Jan. 31, 2019", from Foreign Counterpart to U.S. Appl. No. 16/159,567, pp. 1-21, Published: WO.

Martinez et al., "High-Efficiency FET/Microstrip-Patch Oscillators", IEEE Antennas and Propagation Magazine, Feb. 1994, pp. 16-19, vol. 36, No. 1, IEEE.

Park et al., "A Slotted Post-Wall Waveguide Array With Interdigital Structure for 45° Linear and Dual Polarization", IEEE Transaction on Antennas and Propagation, Sep. 2005, pp. 2865-2871, vol. 53, No. 9, IEEE.

U.S. Patent and Trademark Office, "Office Action", U.S. Appl. No. 16/389,782, dated Sep. 10, 2020, pp. 1 through 35 Published: US.

International Searching Authority, "International Search Report and Written Opinion from PCT Application No. PCT/US2020/028723", from Foreign Counterpart to U.S. Appl. No. 16/389,782, dated Jul. 28, 2020, pp. 1 through 14, Published: WO.

International Bureau, "International Preliminary Report on Patentability from PCT Application No. PCT/US2018/050090", from Foreign Counterpart to U.S. Appl. No. 16/125,486, dated Mar. 19, 2020, pp. 1-13, Published: WO.

Harter, Marlene et al. "Realization of an Innovative 3D Imaging Digital Beamforming Radar System"; 2011 IEEE CIE International Conference; Oct. 24, 2011; pp. 186-189.

International Searching Authority; Notification of Transmittal of the International Search Report and the Written Opinion of the International Searching Authority from PCT Application No. PCT/US2018/039600 dated Oct. 9, 2018; from Foreign Counterpart of U.S. Appl. No. 16/019,371; pp. 1-19; Published: EP.

International Bureau, "International Preliminary Report on Patentability from PCT Application No. PCT/US2018/055737", from Foreign Counterpart to U.S. Appl. No. 16/159,567, dated Apr. 23, 2020, pp. 1 through 17, Published: WO.

"Fan beam Electromagnetism", Academic Press Dictionary of Science and Technology 4th ed.) 1992, Elsevier Science & Technology, Credo Reference: https://search.credoreference.com/content/entry/apdst/fan_beam/0.

(56) References Cited

OTHER PUBLICATIONS

Huang et al., "Antennas: From Theory to Practice", Wiley, Jun. 18, 2008, pp. 1 through 7, A John Wuiley and Sons, Ltd, Publication.
Sakakibara, "High-gain Millimeter-wave Planar Array Antennas with Traveling-wave Excitation", Radar Technology, Dec. 2009, pp. 1 through 24, www.intechopen.com.
U.S. Patent and Trademark Office, "Office Action", U.S. Appl. No. 16/125,486, dated Nov. 25, 2020, pp. 1 through 70, Published: US.
U.S. Patent and Trademark Office, "Final Office Action", U.S. Appl. No. 16/019,371, dated Jan. 8, 2021, pp. 1 through 58, Published: US.
U.S. Patent and Trademark Office, "Notice of Allowance", U.S. Appl. No. 16/019,371, dated Jul. 13, 2021, pp. 1 through 64, Published: US.
U.S Patent and Trademark Office, "Notice of Allowance", U.S. Appl. No. 16/125,486, dated Apr. 21, 2021, pp. 1 through 13, Published: US.
U.S. Patent and Trademark Office, "Notice of Allowance", U.S. Appl. No. 16/389,782, dated May 7, 2021, pp. 1 through 12, Published: US.
U.S. Patent and Trademark Office, "Advisory Action", U.S. Appl. No. 16/019,371, dated May 19, 2021, pp. 1 through 7, Published: US.
European Patent Office, "Communication pursuant to Article 94(3) from EP Application No. 18905896.9", from Foreign Counterpart to U.S. Appl. No. 16/125,486, dated Oct. 27, 2021, pp. 1 through 6, Published: EP.

* cited by examiner

90

100

BEAM-STEERING ANTENNA

CROSS-RELATED APPLICATION(S)

The present patent application claims priority to U.S. Provisional Patent App. Ser. No. 62/572,043, which is titled BEAM-STEERING ANTENNA, which was filed 13 Oct. 2017, and which is incorporated by reference herein.

SUMMARY

FIG. 1 is a diagram, in plan view, of a beam-steering antenna 10, which includes an array of antenna elements 12 arranged in rows 14, a signal port 16, a signal splitter/combiner 18, respective isolation vias 20, and respective termination impedances 22.

FIG. 2 is an enlarged diagram, in plan view, of an antenna element 12 of FIG. 1, and of the isolation vias 20 around the antenna element.

FIG. 3 is a side view, taken along line A-A' of FIG. 2, of an antenna-unit cell 24, which includes the antenna element 12 and the isolation vias 20 of FIG. 2.

Referring to FIGS. 1 and 3, the antenna 10 further includes, beneath each row 14 of antenna elements 12, a respective transmission medium, for example, a waveguide 26, having a front end 28, a back end 30, and a characteristic impedance, and being configured to allow a respective traveling row-reference wave (or signal) to propagate from the front end to the back end during a transmit mode, and to propagate from the back end to the front end during a receive mode.

And referring to FIGS. 2-3, in addition to the antenna element 12 and isolation vias 20, the antenna unit 24 includes a conductive control line 32, a conductive control via 34, and a lumped circuit element 36, which can be an electronically controllable impedance or an electronically controllable switching device such as a surface-mount diode (e.g., a PIN diode), and which has a contact coupled to the antenna element 12 and another contact coupled to a grounded conductor 38 to which the isolation vias 20 are coupled. Because, as described below, the control line 32 and the control via 34 are configured to conduct a DC bias voltage, they can also be called a DC bias line and a DC bias via, respectively. Furthermore, where the lumped circuit element 36 is a diode, in an embodiment the diode's cathode is coupled to the grounded conductor 38 and the diode's anode is coupled to the antenna element 12. Hereinafter, the lumped circuit element 36 is described, at least in some embodiments, as a diode 36 for purposes of example.

The waveguide 26, which is disposed beneath the antenna unit 24, includes a planar conductive ceiling 40 disposed a depth h beneath the antenna element 12 (i.e., the antenna element is disposed at a height h above the conductive ceiling), a planar conductive floor 42, and conductive vias 44, which, together with the DC bias vias 34, form a side wall of the waveguide (another side wall, not shown in FIG. 3, is also formed from vias). The height h can be approximate $\lambda/4$ so that a portion of the element signal radiated inward by the antenna element 12 and reflected by the ceiling 40 constructively interferes with a portion of the element signal radiated outward by the antenna element. Furthermore, because the vias 34 and 44 are spaced apart by approximately a respective distance $d \ll \lambda_m$ ($\lambda_m$ is the wavelength of the row-reference signal in the waveguide 26, and where the waveguide is filled with a substance other than air, $\lambda_m < \lambda_0$, where $\lambda_0$ is the free-space wavelength of the row-reference signal, and is approximately the wavelength of the row-reference signal in air), the vias "appear" to the row-reference signal as a continuous planar conductor. That is, little or none of the energy of the row-reference signal "leaks" out through the spaces between the vias.

Furthermore, a slot, hereinafter an "iris," 46 is formed in the ceiling 40 of the waveguide 26 beneath the antenna element 12. The iris 46 is effectively configured to couple, to the antenna element 12, a fraction of the energy of the reference wave propagating in the waveguide 26 during a transmit mode, and is effectively configured to couple, to the waveguide, energy from a signal incident on the antenna element during a receive mode.

Referring to FIGS. 1-3, each of the antenna elements 12 can be, for example, a respective patch antenna element, and is configured for selective activation or deactivation in response to a respective control signal on the control line 32.

While activated in a transmit mode, each antenna element 12 effectively radiates, as an elemental transmit signal, a respective portion of the row-reference signal that propagates in the respective waveguide 26 disposed beneath the antenna element; and, while deactivated in the transmit mode, the antenna element radiates approximately zero energy, or at least significantly less energy than it would radiate were it activated.

Likewise, while activated in a receive mode, each antenna element 12 effectively converts a signal incident on the antenna element into an elemental received signal, which the respective iris 46 couples to the respective underlying waveguide 26, which effectively combines the elemental receive signals from all of the active antenna elements in the same row 14 into a combined receive signal, and which provides the combined receive signal to the splitter/combiner 18; and, while deactivated in the receive mode, each antenna element couples approximately zero energy to the underlying waveguide, or at least couples significantly less energy than it would couple to the underlying waveguide were the antenna element activated.

The input/output port 16 can be, for example, a coaxial-cable connector, and is configured to couple a transmit reference signal to the splitter/combiner 18 during a transmit mode of operation, and is configured to receive a receive reference signal from the splitter/combiner during a receive mode of operation.

The signal splitter/combiner 18 can be, for example, any suitable signal splitter/combiner, and is coupled between the input/output port 16 and the one or more waveguides 26. During a transmit mode, the signal splitter/combiner 18 is configured to divide a transmit reference signal from the port 16 into respective row-reference signals of approximately equal powers and to couple each row-reference signal to a respective waveguide 26. And during a receive mode, the signal splitter/combiner 18 is configured to combine the receive row-reference signals from the respective waveguides 26 into a receive reference signal and to couple the receive reference signal to the input/output port 16.

The isolation vias 20 allow each antenna element 12 to operate as an independent radiator; that is, the isolation vias prevent the radiation characteristics of one antenna element 12 from affecting the radiation characteristics of another antenna element. Because the isolation vias 20 are coupled between two RF ground conductors 38 and 40, and because the spacing between adjacent isolation vias is <<than the free-space wavelength $\lambda_0$ of the row-reference waves, RF energy that an antenna element 12 radiates inward toward the waveguide 26 is confined to a region 48, which underlies the antenna element 12 and which is bounded by the antenna element on top, the waveguide ceiling 40 on the bottom, and the isolation vias 20 around the sides. Furthermore, RF energy that one or more other antenna elements 12 radiate is blocked from the region 48 by the isolation vias 20.

And to prevent unwanted signal reflections from the back end 30 of each waveguide 26 during transmit and receive modes, a respective termination impedance 22 is coupled to the back end of each waveguide, the termination impedance having approximately the same value as the characteristic impedance (e.g., 50 ohms (a)) of the respective waveguide.

In operation during a transmit mode and a receive mode, a control circuit (not shown in FIGS. 1-3) activates and deactivates the respective antenna elements 12 in time-sequenced predetermined patterns so that the antenna elements generate, and steer, one or more signal beams. For example, the activated antenna elements 12 may generate and steer, at respective times, a transmit radar beam and a receive radar beam.

To activate an antenna element 12, the control circuit (not shown in FIGS. 1-3) generates, and couples to the DC bias via 34, a DC reverse-bias signal; for example, the DC reverse-bias signal can be an active DC reverse-bias voltage having a voltage level of approximately −3.0 Volts (V), where active means that the DC reverse-bias voltage activates the antenna element, i.e., enables the antenna element to radiate an elemental signal.

The DC bias via 34 couples the DC reverse-bias voltage to the DC bias line 32, which couples the DC reverse-bias voltage to the antenna element 12 and to the anode of the diode 36.

Because the waveguide ceiling 40, floor 42, and sidewall vias 44 are grounded, the active DC reverse-bias voltage on the antenna element 12, the bias line 32, and the anode of the diode 36 strongly reverse biases the diode.

Strongly reverse biasing the diode 36 does at least two things.

First, it causes the combination of the antenna element 12, diode 36, and region 48 to couple the iris signal generated by the iris 46 to the antenna element 12, which, in response to the iris signal, generates and radiates an elemental signal. While strongly reverse biased, the combination of the antenna element 12, diode 36, and region 48 underlying the antenna element is configured to act as a resonant circuit having a resonant frequency approximately equal to the frequency of the row-reference signal (the antenna unit 24 is typically designed for a row-reference signal having a particular frequency (or wavelength), or having a frequency (or wavelength) in a particular range). The diode 36, in effect, forms a capacitor that is in electrical parallel with the series combination of the antenna element 12 and the underlying region 48. Reverse biasing the diode 36 causes this capacitor to have a capacitance value that sets the resonant frequency of the combination of the antenna element 12, diode, and underlying region 48 at approximately the frequency of the row-reference signal.

Second, because the activated antenna element 12, diode 36, and underlying region 48 effectively form a circuit that resonates at approximately the frequency of the row-reference signal, the phase shift that this effective circuit applies to signals transmitted and received during a transmit mode and a receive mode, respectively, is approximately zero. The reason for this approximately zero phase shift is because at resonance, the imaginary (Im) component of the effective circuit's impedance is approximately zero.

To deactivate the antenna element 12, the control circuit (not shown in FIGS. 1-3), causes an inactive DC forward-bias (e.g., forward voltage) signal to be coupled to the DC bias via 34 so as to forward-bias the diode 36; for example, the forward-bias signal can be a DC positive voltage having a voltage level of approximately +2.0 V. Here, inactive means that the DC forward-bias voltage deactivates the antenna element, i.e., disables the antenna element from radiating an elemental signal.

The DC bias via 34 couples the inactive DC forward-bias voltage to the DC bias line 32, which couples the DC forward-bias voltage to the antenna element 12 and to the anode of the diode 36.

Because the waveguide ceiling 40, floor 42, and sidewall vias 44 are grounded, the inactive DC forward-bias voltage on the antenna element 12, the bias line 32, and the anode of the diode 36 strongly forward biases the diode.

While forward biased, the diode 36 is configured to cause the combination of the antenna element 12, diode, and region 48 to uncouple the iris signal generated by the iris 46 from the antenna element 12, and, therefore, is configured to cause the antenna element to radiate an elemental signal of insignificant or no power. Strongly forward biasing the diode 36 causes the diode to act as a conductor, and, therefore, causes the diode acts as a weak inductor. This inductive impedance is drastically different (a phase-sign change) from the impedance value that the capacitor has while the diode is strongly reversed biased. This change in diode impedance shifts the resonant frequency of the combination of the antenna element 12, diode 36, and underlying region 48 away from the frequency of the row-reference signal, far enough away that, at the frequency of the row-reference signal, the impedance of this combination is too high to couple the iris signal to the antenna element during a transmit mode, and too high to couple the elemental signal to the iris 46 during a receive mode.

Still referring to FIGS. 1-3, operation of the antenna 10 during a transmit (i.e., signal-transmission) mode is described.

A transmit reference signal from a reference-signal generator (not shown in FIGS. 1-3) is coupled to the input/output port 16.

The splitter/combiner 18 splits the transmit reference signal into transmit row-reference signals each having approximately the same power, and provides each transmit row-reference signal to a front end 28 of a respective wave guide 26 beneath a respective row 14 of antenna units 24.

Each transmit row-reference signal excites, in a respective waveguide 26, a respective traveling row-reference wave that propagates along the respective waveguide from the front end 28 to the back end 30. As the traveling row-reference wave propagates along the waveguide 26, its amplitude, and thus its power, decay approximately exponentially (generally according to $e^{-x}$) from the front end 28 to the back end 30 due to signal attenuation caused primarily by power couplings to the irises 46 and signal losses in the waveguide.

Each iris 46 generates, from the transmit row-reference wave propagating in the waveguide 26, a respective transmit iris signal. That is, effectively, each iris 46 allows a portion of the transmit row-reference wave to propagate through the iris, although the signal generated by the iris can have a different polarization than the transmit row-reference wave. The details of how an iris 46 generates a transmit iris signal from the transmit row-reference wave are well known and, therefore, are not described herein.

The control circuit (not shown in FIGS. 1-3) generates, on each DC bias via 34, either an "on" reverse-bias voltage (e.g., −3.0 V) or an "off" forward-bias voltage (e.g., +2.0 V) to yield a predetermined pattern of activated and deactivated antenna elements 12.

For each activated antenna element 12, the respective underlying region 48 couples the respective transmit iris signal from the respective iris 46 to the activated antenna element, which, in response to the transmit iris signal, radiates a respective transmit elemental signal.

For each deactivated antenna element 12, the respective coupling region 48 attenuates the respective transmit iris signal from the respective iris 46 such that the deactivated antenna element effectively does not radiate a transmit elemental signal. Said another way, the deactivated antenna element 12 radiates a respective transmit elemental signal having approximately zero energy, or at least having an energy significantly less than the energy that the antenna element would radiate if it were activated.

The transmit elemental signals respectively radiated by the activated antenna elements 12 interfere with one another to form one or more beams, for example, one or more radar beams. That is, the transmit elemental signals respectively radiated by the activated antenna elements form an interference pattern that includes one or more beams.

The control circuit (not shown in FIGS. 1-3) changes the pattern of activated and deactivated antenna elements 12 to steer the one or more beams in one or two dimensions across a one- or two-dimensional field of view (FOV).

Still referring to FIGS. 1-3, operation of the antenna 10 during a receive (i.e., signal-receiving) mode is described.

A signal from a remote source is incident on the antenna elements 12. For example, the signal may be a portion of a signal previously transmitted by the antenna 10 and redirected back to the antenna by an object within the antenna's FOV.

The control circuit (not shown in FIGS. 1-3) generates, on each DC bias via 34, either an "on" reverse-bias voltage (e.g., −3.0 V) or an "off" forward-bias voltage (e.g., +2.0 V) to generate a predetermined pattern of activated and deactivated antenna elements 12.

The pattern of activated and deactivated antenna elements 12 effectively forms an interference pattern that includes one or more receive beams.

Each active antenna element 12 radiates a respective receive elemental signal in response to the incident signal.

For each activated antenna element 12, a respective underlying region 48 couples the receive elemental signal radiated by the antenna element to a respective iris 46.

Each corresponding iris 46 generates, from the respective receive elemental signal radiated by the activated antenna element 12, a receive iris signal that excites a receive row-reference signal in the waveguide 26. That is, effectively, the iris 46 couples the receive elemental signal radiated by the activated antenna element 12 to the waveguide 26, although the receive iris signal generated by the iris can have a different polarization than the receive row-reference signal. The details of how an iris 46 excites a receive row-reference signal in a waveguide 26 are well known and, therefore, are not described herein.

For each deactivated antenna element 12, the respective underlying region 48 attenuates the receive elemental signal from the antenna element such that respective iris 46 does not contribute to the excitation of a receive row-reference signal in the waveguide 26. Said another way, the respective iris 46 couples approximately zero energy into the waveguide 26, or at least couples an energy significantly less than the energy that the iris would couple if the corresponding antenna element 12 were activated.

The receive iris signals generated by the irises 46 associated with active antenna elements 12 excite, in each waveguide 26, a respective receive row-reference signal, at least a portion of which propagates to the front end 28 of the waveguide and into a respective terminal of the splitter/combiner 18. The respective portion of the receive row-reference signal excited by each iris 46 decays exponentially as it propagates to the front end 28 of the waveguide 26.

The splitter/combiner 18 combines the received row-reference signals into a received reference signal, and the received reference signal propagates to the control circuitry (not shown in FIGS. 1-3) via the input/output port 16.

And the control circuitry (not shown in FIGS. 1-3) analyzes the receive reference signal. For example, if the antenna 10 forms part of a radar system or subsystem, the control circuitry analyzes the receive reference signal to determine, e.g., whether an object in the FOV of the antenna 10 redirected, along the path(s) of the one or more receive beams formed by the current pattern of activated and deactivated antenna elements 12, a portion of a signal that the antenna previously transmitted. The control circuitry can also determine characteristics of the object such as its size, shape, distance from the antenna 10, and the substance(s) from which it is made. Alternatively, the antenna 10 can form part of any other suitable system or subsystem such as a wireless-communication system or subsystem.

By sequentially changing the pattern of activated and deactivated antenna elements 12, the control circuit (not shown in FIGS. 1-3) can steer the one or more receive beams in one or two dimensions across a one- or two-dimensional receive FOV of the antenna 10.

Still referring to FIGS. 1-3, as innovative and useful as the antenna 10 is, it still may have one or more problems.

For example, under some conditions, the DC bias lines 32 can cause undesired cross-polarization of the elemental signals generated or received by the antenna elements 12. That is, one or more of the DC bias lines 32 may, during a transmit or a receive mode, radiate a signal that has a different polarization than the elemental signal radiated by the corresponding antenna element 12.

Furthermore, energy radiated by an antenna element 12 can excite radio-frequency (RF) signals in the corresponding DC bias line 32 and DC bias via 34, and these RF signals can excite unwanted modes in the respective waveguide 26, and can even damage the circuitry (not shown in FIGS. 1-3) that generates the DC bias signals.

Moreover, the structure used to terminate the back end 30 of each waveguide 26 can be expensive and bulky, and, therefore, can increase the size of the antenna 10 beyond the size that the antenna elements 12 alone would justify. For example, the structure may be a coaxial connector that is configured to terminate a waveguide 26 during operation of the antenna 10, but that is also configured to allow connection of a probe during testing of the antenna without allowing significant signal reflections in the waveguide due to an effective termination impedance that is not matched to the waveguide's characteristic impedance.

In addition, the waveguides 26 can increase the size of the antenna 10 beyond the size that the antenna elements 12 alone would justify, and the relatively large number of sidewall vias 44 can increase the complexity and expense of manufacturing the antenna.

Furthermore, the decay of a transmit row-reference signal as it propagates along a waveguide 26 can cause, at least effectively, the power of the respective transmit elemental signal radiated by each antenna element 12 to be different, i.e., to depend on the antenna element's position in the row 14 of antenna units 24.

Moreover, the decay of a receive row-reference signal as it propagates along a waveguide 26 can cause, at least effectively, the power of respective receive elemental signals received by each antenna element 12 to be different at the port 16, i.e., to depend on the antenna element's position in the row 14 of antenna units 24.

Accordingly, each of the following embodiments is designed to solve at least one of the above-described problems.

According to an embodiment, an antenna includes a conductive antenna element, a voltage-bias conductor, and a polarization-compensation conductor. The conductive antenna element is configured to radiate a first signal having a first polarization, and the voltage-bias conductor is coupled to a side of the antenna element and is configured to radiate a second signal having a second polarization that is different from the first polarization. And the polarization-compensating conductor is coupled to an opposite side of the antenna element and is configured to radiate third a signal having a third polarization that is approximately the same as the second polarization and that destructively interferes with the second signal.

For example, such an antenna can reduce or eliminate cross-polarization caused by a bias line such as the bias line 32 of FIG. 2.

According to another embodiment, an antenna includes a conductive antenna element, a conductive signal-bypass stub, and a conductive voltage-bias via. The conductive signal-bypass stub is disposed below the conductive antenna element, and the conductive voltage-bias via is coupled to the antenna element and to the signal-bypass stub.

For example, such an antenna can prevent an RF signal from exciting an unwanted mode in a waveguide such as a waveguide 26, from damaging circuitry that generates a DC reverse-bias voltage or a DC forward-bias voltage on a via such as the DC bias via 34, and from altering the transmit or receive characteristics of an antenna unit 24.

According to yet another embodiment, an antenna includes a transmission medium and an impedance-termination structure. The transmission medium has a characteristic impedance and an end, and is configured to carry a signal having a wavelength. And the impedance-termination structure is disposed approximately at the end of the transmission medium, is configured to have approximately zero impedance at the wavelength, and is configured to couple, to the end of the transmission medium, an impedance structure having approximately the characteristic impedance as the transmission medium.

For example, such an antenna can prevent unwanted signal reflections in waveguides during testing via probes, and during transmit and receive modes, without the need for a bulky or costly impedance-termination structure. For example, after test, resistive surface-mount components of an appropriate impedance may be placed via standard techniques to terminate the waveguide so as to reduce or inhibit undesired reflections.

According to still another embodiment, an antenna includes a first row of antenna elements, a first waveguide, a second row of antenna elements, and a second waveguide. The first waveguide is disposed beneath the first row of antenna elements and includes a side formed by a row of spaced-apart conductive vias. And the second waveguide is disposed beneath the second row of antenna elements and includes a side formed by the same row of the spaced-apart conductive vias.

By sharing via walls among waveguides, the size of such an antenna, and its manufacturing complexity and expense, can be reduced as compared to an antenna in which each waveguide has its own walls.

According to another embodiment, an antenna includes a first row of antenna elements, a first waveguide, a second row of antenna elements, and a second waveguide. The first waveguide is disposed beneath the first row of antenna elements and includes a side formed by a row of spaced-apart conductive vias, every other one of the vias electrically coupled to a respective antenna element in the first row. The second row of antenna elements is offset relative to the first row of antenna elements, and the second waveguide is disposed beneath the second row of antenna elements and includes a side formed by the same row of the spaced-apart conductive vias, every other one of the vias not electrically coupled to an antenna element in the first row electrically coupled to a respective antenna element in the second row.

Such offsetting antenna elements in adjacent rows can further reduce the complexity and expense of manufacturing the antenna.

According to yet another embodiment, an antenna includes a row of antenna elements, a transmission medium, and coupling structures. The transmission medium is disposed beneath the row of antenna elements and has a receiving end and an opposite end. And the coupling structures are each configured to couple, to a respective one of the antenna elements, an approximately same power from a signal propagating along the transmission medium from the receiving end to the opposite end.

For example, such an antenna may have improved transmit and receive radiation patterns because the signal power radiated by each antenna element in a row is approximately uniform across the length of the row despite decay of a row-reference signal propagating through the corresponding waveguide. And the signal powers of the receive components that form a row-reference signal during a receive mode are approximately uniform at an output port of a corresponding waveguide despite a different level of decay that each of the receive components experiences as it propagates through the corresponding waveguide.

DETAILED DESCRIPTION

Each non-zero value, quantity, or attribute herein preceded by "substantially," "approximately," "about," a form or derivative thereof, or a similar term, encompasses a range that includes the value, quantity, or attribute±20% of the value, quantity, or attribute, or a range that includes±20% of a maximum difference from the value, quantity, or attribute. And for a zero-value, the encompassed range is ±1 of the same units unless otherwise stated.

Figure 1:
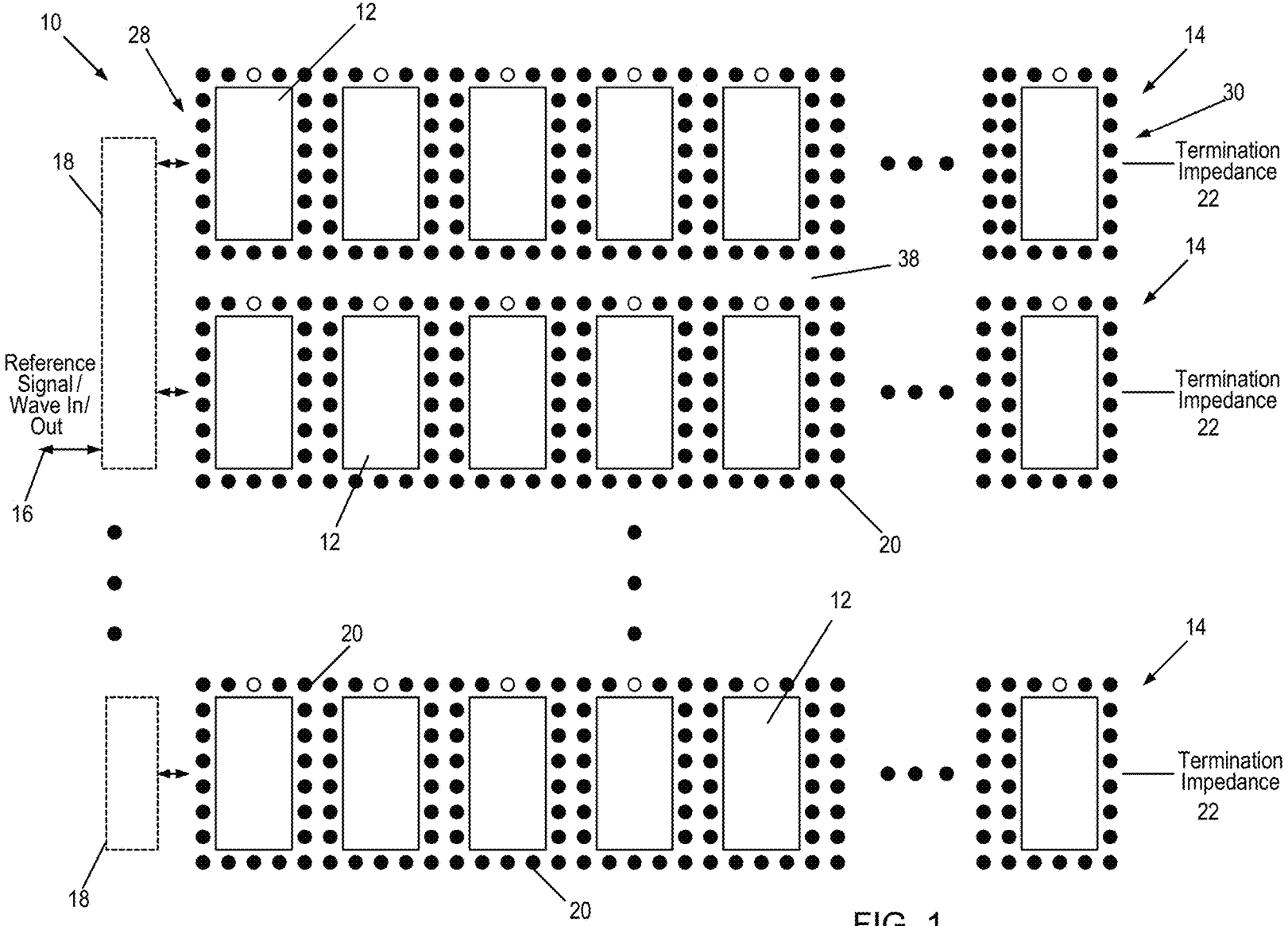
FIG. 1 is a diagram, in plan view, of a beam-steering antenna.
Figure 3:
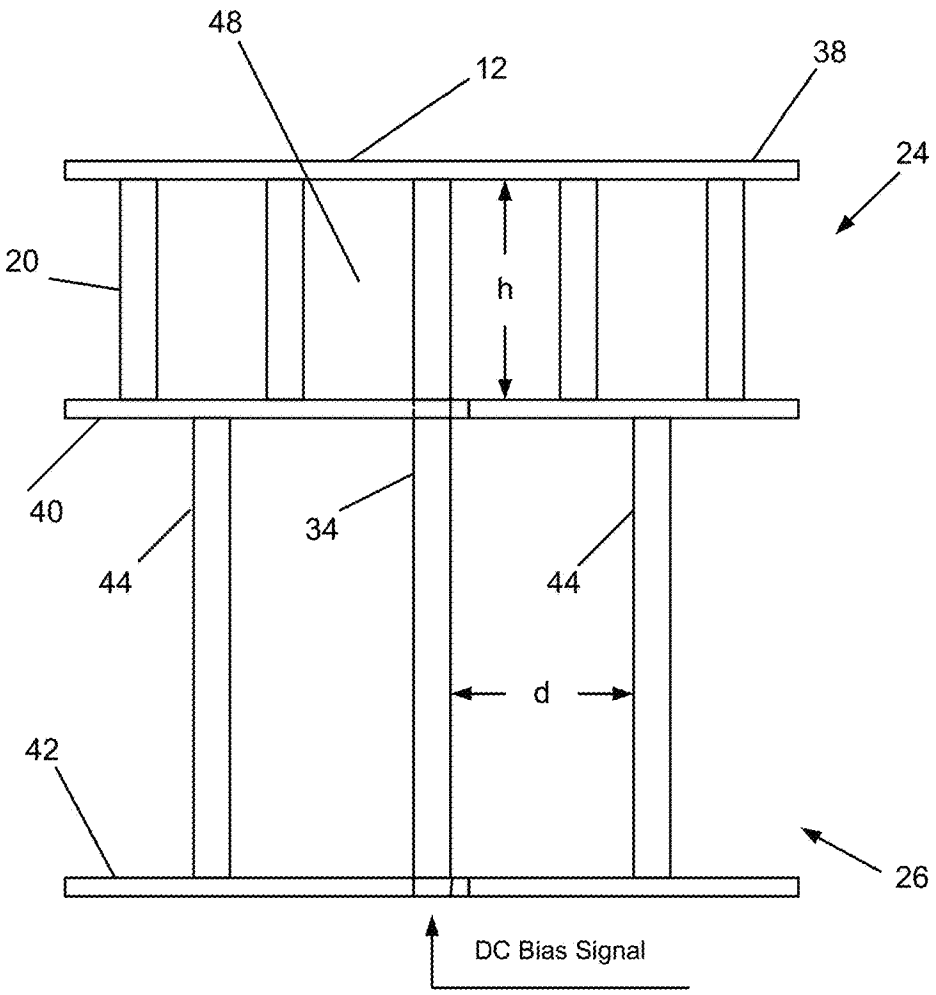
FIG. 3 is a side view, taken along lines A-A', of the antenna unit of FIG. 2.
Figure 2:
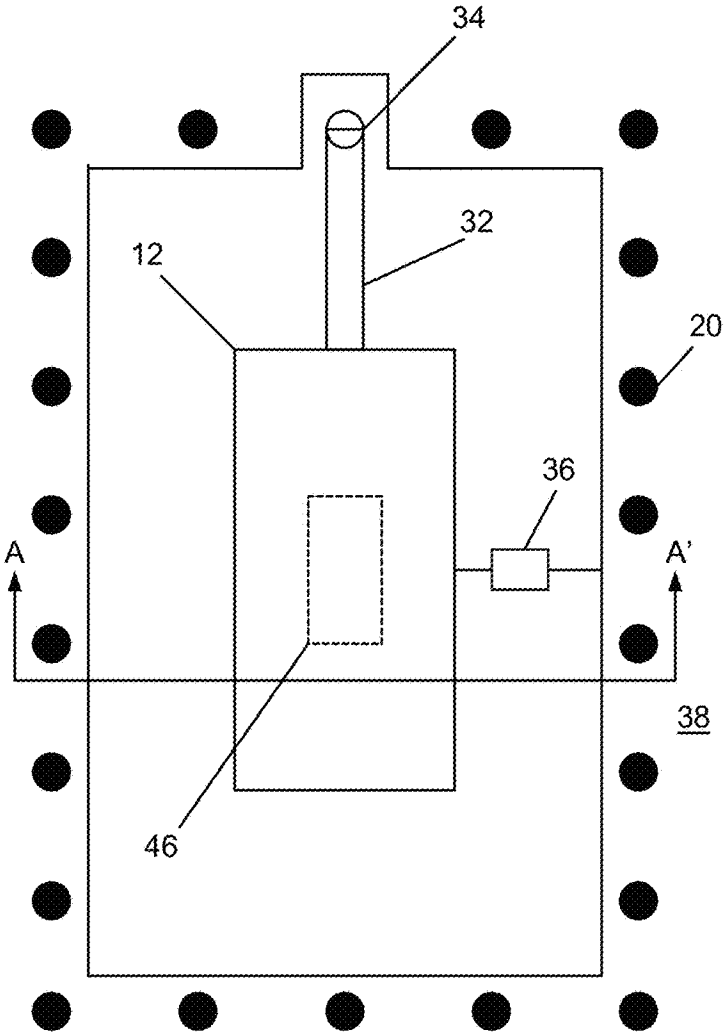
FIG. 2 is an enlarged diagram, in plan view, of an antenna unit of FIG. 1.
Figure 4:
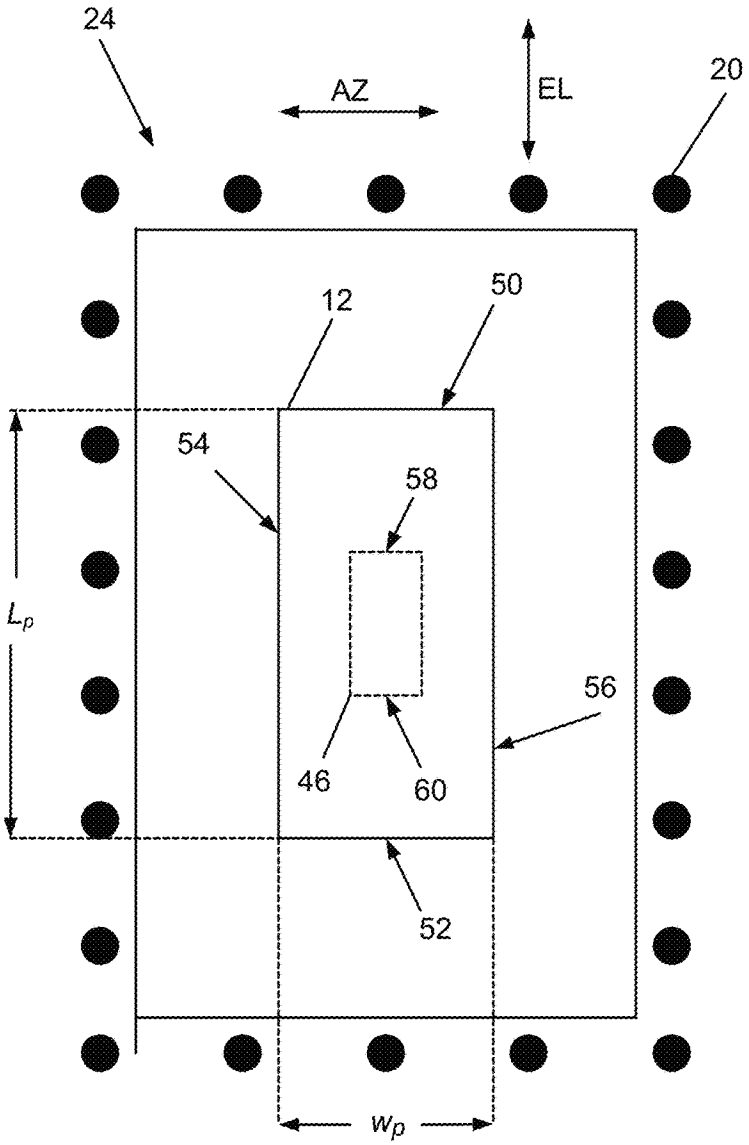
FIG. 4 is diagram, in plan view, of an antenna unit without a bias line, bias via, or diode.

FIG. 4 is a diagram, in plan view, of an antenna unit 24 of the antenna 10 of FIGS. 1-3 without the bias line 32 and without the diode 36. The antenna element 12 of the antenna unit 24 has, between ends 50 and 52, a length $L_p$ selected such that a radiation pattern generated by the antenna element, and a radiation pattern generated by the antenna 10, each have desired envelopes in the elevation (EL) dimension. And the antenna element 12 has, between sides 54 and 56, a width $w_p$ of approximately $\lambda_0/2$, where $\lambda_0$ is the free-space wavelength of the transmit row-reference wave that propagates through the waveguide 26 (FIG. 3) beneath the antenna unit 24. For example, where it is desired that the antenna element 12 operate in a resonant mode at the wavelength $\lambda_0$, the width $w_p$ of the antenna element 12 is typically reduced below $\lambda_0/2$ due to the loading of the antenna element by the underlying region 48 (e.g., dielectric-impedance load) and by the "cage" (e.g., capacitive load) formed around the antenna element by the isolation vias 20. Said another way, a reduction in $w_p$ allows the so-loaded antenna element 12 to have a resonant frequency approximately equal to the frequency of the transmit row-reference signal in the presence of loading.

Operation of the antenna unit 24 during a transmit mode is described according to an embodiment in which it is assumed that the transmit row-reference wave has a wavelength km and propagates through the waveguide 26 (FIG. 3) beneath the antenna unit 24 according to a $TE_{1,0}$ mode such that the electric field of the reference wave is orthogonal to the waveguide ceiling 40 (FIG. 3). As is known, $\lambda_m$, the wavelength of the transmit row-reference wave in the waveguide 26, is different from the free-space wavelength $\lambda_0$ of the transmit row-reference signal where the value of at least one of $\varepsilon_m$ (electrical permittivity inside of the waveguide) and $\mu_m$ (magnetic permeability inside of the waveguide) is different from a respective at least one of the values of $\varepsilon_0$ (electrical permittivity in free space) and $\mu_0$ (magnetic permeability in free space). For example, if the waveguide 26 is filled with air, then $\lambda_m \approx \lambda_0$ because $\varepsilon_{air} \approx \varepsilon_0$ and $\mu_{air} \approx \mu_0$, and, therefore, because the velocity of the transmit row-reference signal in the waveguide is approximately equal to the velocity of the transmit row-reference signal in free space. But if the waveguide 26 is filled with another material (e.g., a dielectric material), then $\lambda_m < \lambda_0$ because $\varepsilon_m \neq \varepsilon_0$, $\mu_m \neq \mu_0$, or both $\varepsilon_m \neq \varepsilon_0$ and $\mu_m \neq \mu_0$, and, therefore, because the velocity of the transmit row-reference wave in the waveguide is less than the velocity of the reference wave in free space. Furthermore, for purposes of example, it is assumed that the wavelength of an iris signal or receive elemental signal in the region 48 (FIG. 3) is also $\lambda_m$, although the wavelength of a signal in the region 48 may be different than the wavelength of the signal in the waveguide 26 and different than the wavelength of the signal in air or free space.

According to a known phenomenon, the transmit row-reference wave induces currents in the waveguide ceiling 40 (FIG. 3), and these currents cause the iris 46 to radiate an iris signal having the frequency of the transmit row-reference wave and having an electric field $\vec{E}_{iris}$ primarily in the azimuth (AZ) dimension (except at iris ends 58 and 60 due to fringe effects).

While the antenna element 12 is activated (assume the antenna element is activated in the manner described above in conjunction with FIGS. 1-3 even though the bias line 32 is omitted from the antenna unit 24 of FIG. 4), the transmit iris signal, which has the wavelength $\lambda_m$, excites the antenna element in a resonant mode (because the width $w_p$ of the antenna element is approximately $\lambda_0/2$) such that the antenna element radiates a transmit elemental signal.

Figure 5:
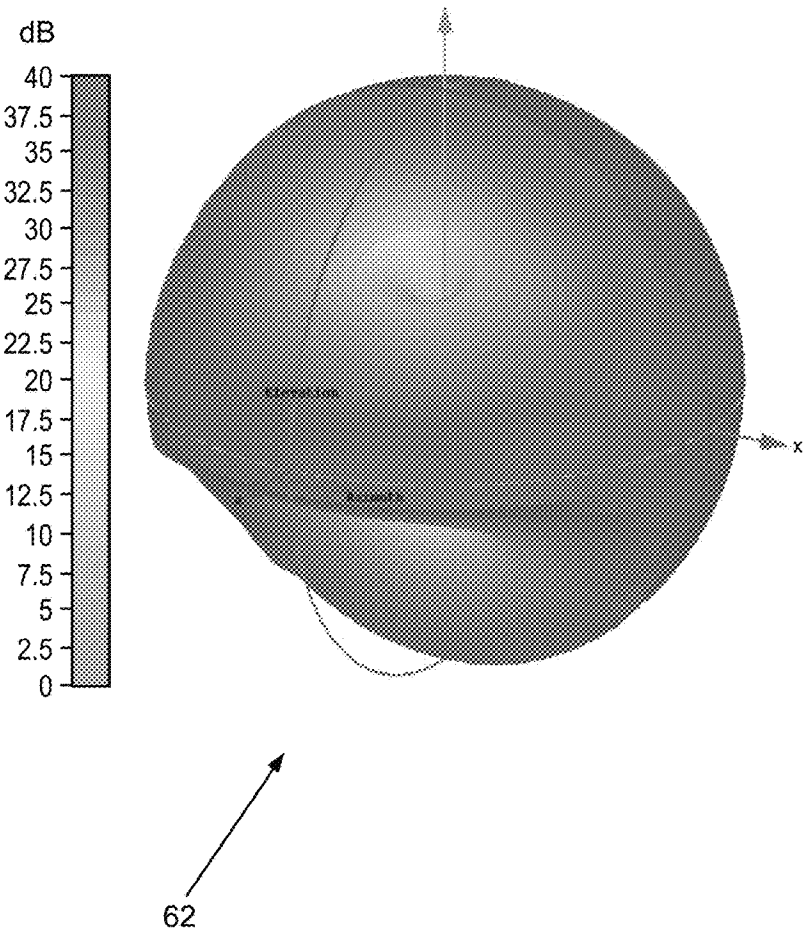
FIG. 5 is three-dimensional plot, in decibels (dB), of the electric-field polarization of the transmit elemental signal radiated by the antenna element of FIG. 4.

FIG. 5 is a three-dimensional plot 62 of the polarization pattern of the transmit elemental signal that the activated antenna element 12 of FIG. 4 radiates. The quantity plotted is the ratio, in dB, of $$\left|\frac{\vec{E}_{element_AZ}}{\vec{E}_{element_EL}}\right|,$$

where $\vec{E}_{element_AZ}$ is the component of the radiated transmit elemental signal having an electric field oriented, as desired, in the AZ direction, and where $\vec{E}_{element_EL}$ is the component of the radiated transmit elemental signal having an electric field oriented, as is undesired, in the EL direction.

The plot 62 shows that along the boresight (angle $\alpha_{el}$ in the EL direction equals 0°) of the antenna element 12, the radiated transmit elemental signal has an electric field oriented primarily in the AZ direction as desired (represented by the darker regions of the plot), and only at higher and lower elevation angles $\alpha_{el}$ (e.g., $\alpha_{el}\geq 45°$, $\alpha_{el}\leq -45°$) does a significant component of the radiated transmit elemental signal have an electric field undesirably oriented in the EL direction (represented by the lighter regions of the plot). That is, the plot 62 shows that there is insignificant cross-polarization along the boresight ($\alpha_{el}=0°$), but a greater, and significant, level of cross-polarization at higher and lower elevation angles $\alpha_{el}$ (e.g., $\alpha_{el}\geq 45°$, $\alpha_{el}\leq -45°$). Electric-field fringe effects at the ends 50 and 52 of the antenna element 12 are the primary cause of the greater level of cross-polarization at higher and lower elevation angles.

Significant levels of cross-polarization can cause one or more problems in some applications. For example, where the antenna 10 is used as a radar antenna, cross-polarization can reduce the signal power returned from, and, therefore, can reduce the radar sensitivity to, highly anisotropic objects (e.g., horizontal wires such as power lines) that have a large projection in the AZ dimension but a small projection in the EL dimension. Furthermore, cross-polarization can increase manufacturing time and cost because during calibration of the antenna 10, two sets of measurements are taken, one for each polarization (only one set of measurements would need to be taken if polarization were only in one dimension). Moreover, cross-polarization can excite unwanted modes or other characteristics of the antenna element 12.

But in many applications, the significant level of cross-polarization at higher and lower elevation angles is not a problem because the FOV of the antenna 10 in EL is narrow enough to avoid the regions of significant cross-polarization. For example, the levels of cross-polarization shown in FIG. 5 may not be a problem for an application in which the antenna 10 were to have an FOV in EL that is less than, or equal to, ±30°.

Figure 6:
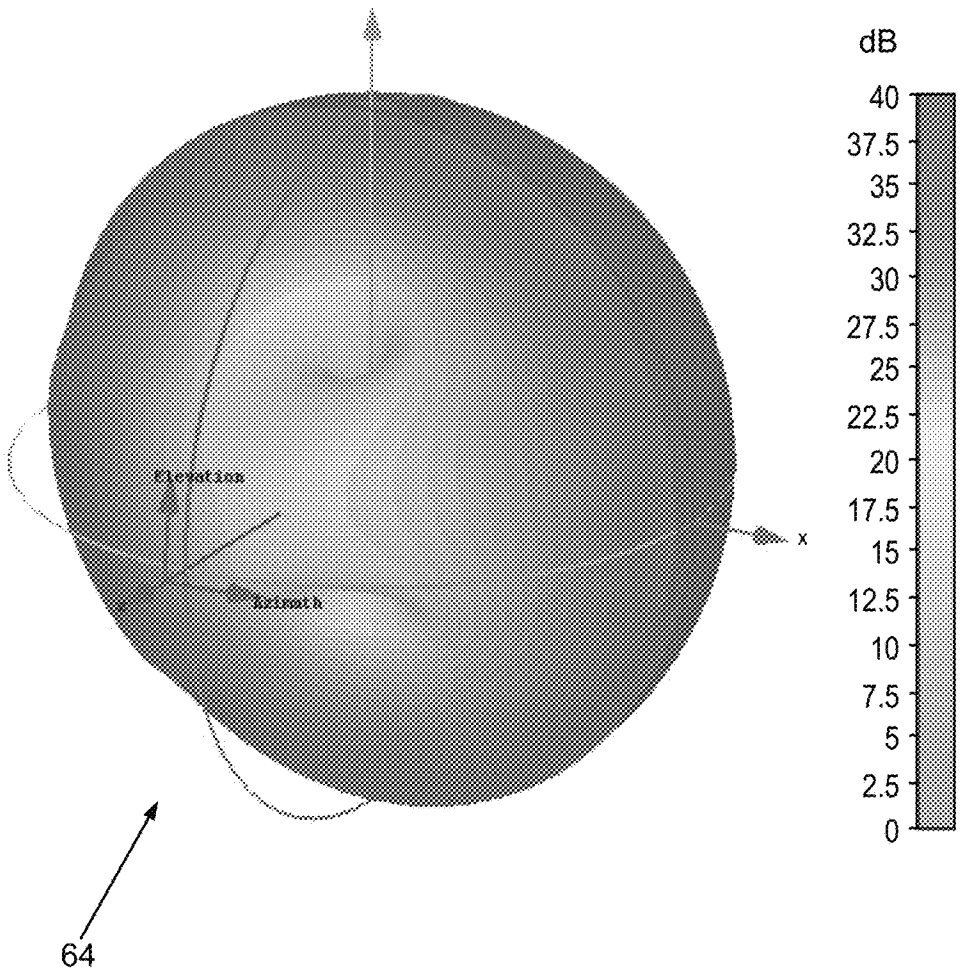
FIG. 6 is three-dimensional plot, in decibels (dB), of the electric-field polarization of the combined signal radiated by the antenna element and bias line of FIG. 2.

FIG. 6 is a three-dimensional plot 64 of the polarization pattern of the total transmit signal that the activated antenna element 12 and the bias line 32 of FIG. 2 radiate. Like the plot 62 of FIG. 5, the quantity plotted in the plot 64 is the ratio, in dB, of $$\frac{\vec{E}_{total_AZ}}{\vec{E}_{total_EL}},$$

where $\vec{E}_{total_AZ}$ is the component of the radiated total transmit signal having an electric field oriented, as desired, in the AZ direction, and where $\vec{E}_{total_EL}$ is the component of the radiated total transmit signal having an electric field oriented, as is undesired, in the EL direction.

Figure 7:
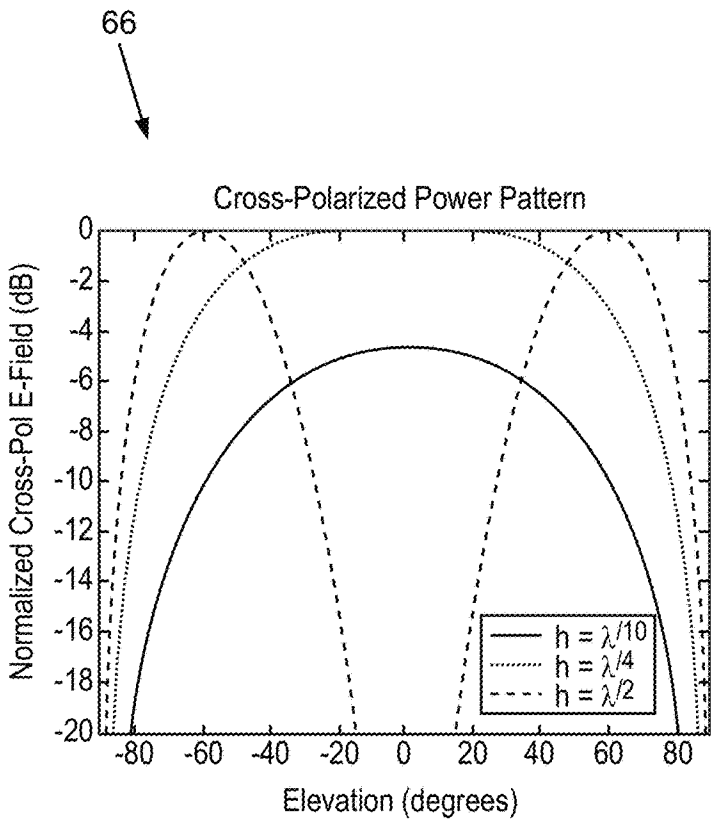
FIG. 7 is a plot, in decibels (dB), of the undesired-electric-field-polarization signal radiated by the antenna element and bias line of FIG. 4 versus elevation for different antenna-element heights h.

FIG. 7 is a plot 66 of the level of cross-polarization versus elevation angle for different values of the height h (FIG. 3) between the antenna element 12/bias line 32 and the ceiling 40 of the underlying waveguide 26, where the level of cross-polarization is the ratio, in dB, of $$\frac{\vec{E}_{total_AZ}}{\vec{E}_{total_EL}}.$$

The plots 64 and 66 shows that the presence of the bias line 32 (FIG. 2) causes a significant level of undesired cross-polarization along the boresight ($\alpha_{el}=0°$), and at lower elevation angles, particularly for larger values of the height h. For example, for $h=\lambda_m/4$, the power of the total signal component with an undesired polarization in EL is approximately equal to the power of the total signal component with a desired polarization in AZ for $-20°\leq\alpha_{el}\leq+20°$. That is, for $-20°\leq\alpha_{el}\leq+20°$, $$\frac{\vec{E}_{total_AZ}}{\vec{E}_{total_EL}} \approx 1 \text{ (0 dB)}.$$

Furthermore, it can be shown that in general, $\vec{E}_{total_EL}$ is proportional to $\sin(kh\cos\alpha_{el})$, where $\lambda_m=2\pi/\lambda_m$ (the wave number in the dielectric material from which the region 48 of the antenna unit 24 is formed), h is the height between the antenna element 12/bias line 32 and the waveguide ceiling 40, and $\alpha_{el}$ is the elevation angle.

Referring to FIGS. 2-3, it is theorized that the reason that the bias line 32 causes significant cross-polarization at lower elevation angles is as follows. Even though the bias line 32 is orthogonal to the electric field $\vec{E}_{iris}$ of the transmit iris signal radiated by the iris 46, and is located at approximately the voltage null of the antenna element 12 (per above, the width $w_p$ of the antenna element is approximately $\lambda_0/2$ so the voltage null is approximately along the horizontal center of the antenna element), currents flow in the bias line, which, therefore, acts as a pseudo dipole antenna and radiates a signal having an electric field $\vec{E}_{bias}$ in the EL dimension. Said another way, the bias line 32 causes cross-polarization of the total signal radiated by the primary radiators (antenna element 12, bias line 32) of the antenna unit 24 by radiating a bias signal having an electric field $\vec{E}_{bias}$ that is orthogonal to the electric field $\vec{E}_{element_AZ}$ of the primary component of the transmit elemental signal that the antenna element 12 radiates. And for $h=\lambda_m/4$, the component of the transmit bias signal radiated inward (toward the waveguide 26) by the bias line 32 is redirected by the waveguide ceiling 40 such that the redirected component constructively interferes with the component of the transmit bias signal radiated outward by the bias line. Therefore, the redirected component promotes, not inhibits, outward radiation of the transmit bias signal by the bias line 32.

Figure 8:
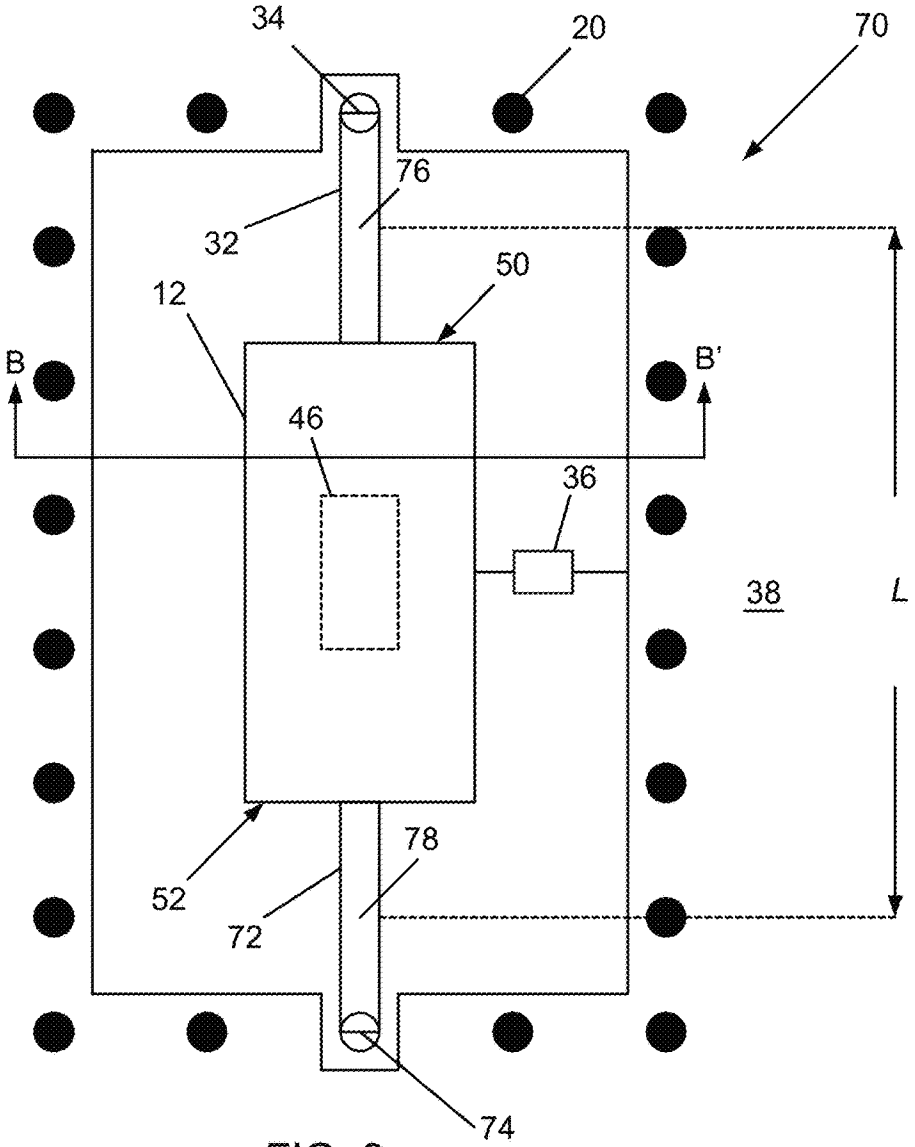
FIG. 8 is diagram, in plan view, of an antenna element with a bias line and a polarization-compensation line, according to an embodiment.

FIG. 8 is a diagram, in plan view, of an antenna unit 70 configured to generate a reduced level of cross-polarization, according to an embodiment in which components common to FIGS. 2, 4, and 8 are labeled with the same reference numerals.

The antenna cell 70 is similar to the antenna cell 24 of FIG. 2 except that it also includes a polarization-compensation line 72 (also called a "dummy bias line" or a "dummy line") and a polarization-compensation via 74 (also called a "dummy bias via" or a "dummy via").

The compensation line 72 has approximately the same dimensions as, and is approximately aligned in the EL direction with, the bias line 32, but is disposed at the end 52 of the antenna element 12 opposite the end 50 at which the bias line is disposed. Furthermore, the compensation via 74 has approximately the same dimensions as, and is aligned in the EL direction with, the bias via 34 (FIG. 2), but is disposed at the end of the compensation line opposite to the end of the bias line at which the bias via is located. Moreover, neither the compensation line 72 nor the compensation via 74 is connected to a reverse-bias voltage or a forward-bias voltage during operation of the antenna unit 70, but instead, both the compensation line and the compensation via "float" electrically at low frequencies. That is, the compensation line 72 and the compensation via 74 are not grounded or forced to any other voltage level at low frequencies. In addition, a distance L is defined as the distance between the vertical (EL direction) centers 76 and 78 of the bias line 32 and the compensation line 72.

Still referring to FIG. 8, in operation during a transmit mode of an antenna of which the antenna unit 70 forms a part, the compensation line 72 radiates a transmit compensation signal in a manner similar to the way in which the bias line 32 radiates a transmit bias signal as described above, where the transmit compensation signal has an electric field $\vec{E}_{compensation}$. Like the electric field $\vec{E}_{bias}$ of the transmit bias signal radiated by the bias line 32, $\vec{E}_{compensation}$ is oriented in the EL dimension, and $\vec{E}_{compensation}$ has approximately the same magnitude as $\vec{E}_{bias}$. But $\vec{E}_{compensation}$ has a phase that is approximately opposite to the phase of $\vec{E}_{bias}$. That is, $\vec{E}_{compensation}$ is approximately equal in magnitude to, but is approximately 180° out of phase with, $\vec{E}_{bias}$. Therefore, the transmit compensation signal radiated by the compensation line 72 tends to destructively interfere with the transmit bias signal radiated by the bias line 32. The result is that the compensation signal reduces the level of cross-polarization of the total transmit signal radiated by all of the primary radiators (antenna element 12, bias line 32, polarization-compensation line 72) of the antenna unit 70, particularly along the boresight ($\alpha_{el}$=0°) of the antenna cell and at lower elevation angles $\alpha_{el}$.

Figure 9:
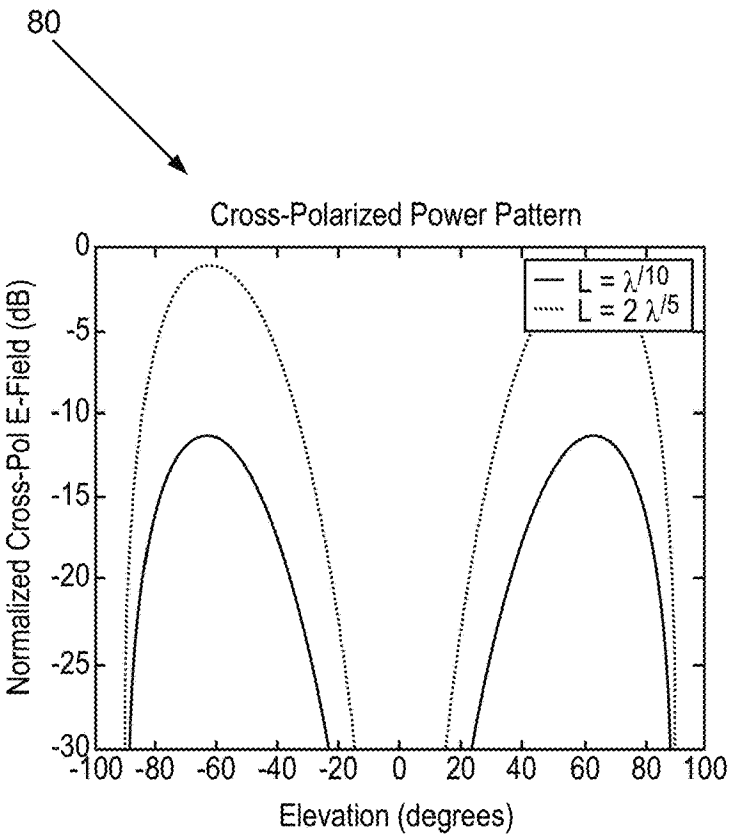
FIG. 9 is plot, in decibels (dB), of the undesired-electric-field-polarization of the combined signal radiated by the antenna element, bias line, and polarization-compensation line of FIG. 8 versus elevation for different bias-line/compensation-line separations, according to an embodiment.

FIG. 9 is a plot 80 of the level of cross-polarization generated by the antenna unit 70 of FIG. 8 versus elevation angle $\alpha_{el}$ for height $h=\lambda_m/4$ (FIG. 3) and for different values (e.g., $\lambda_0/10$, $2\lambda_0/5$) of the distance L (FIG. 8), where the level of cross-polarization is the ratio, in $$\frac{\vec{E}_{total_AZ}}{\vec{E}_{total_EL}}.$$

A comparison of the plot 80 to the $h=\lambda_m/4$ curve of the plot 66 of FIG. 7 shows that the addition of the polarization-compensation line 72 significantly reduces, or eliminates, the level of cross-polarization in the total transmit signal radiated by the combination of the primary radiators (antenna element 12, bias line 32, compensation line 72) of the antenna unit 70, particularly for $-20° \leq \alpha_{el} \leq +20°$. It can be shown that in general, $\sqrt{E}_{total_EL}$ (the EL component of the electric field of the total transmit signal radiated by the antenna cell 70) is proportional to $\sin(kh \cos \alpha_{el})\sin(L/2k_0 \sin \alpha_{el})$ where $k_0=2\pi/\lambda_0$ is the free-space wave number.

Figure 10:
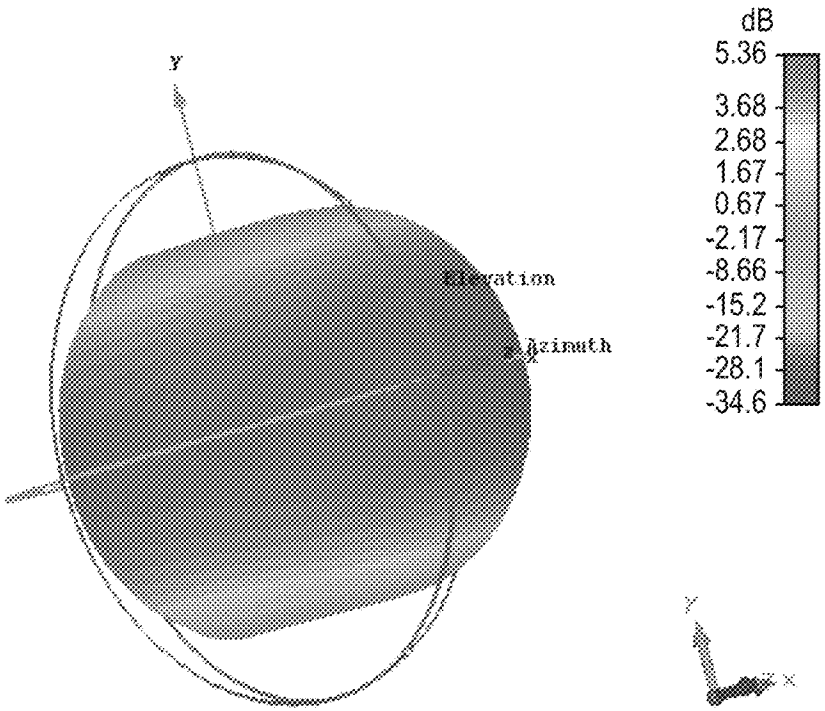
FIG. 10 is three-dimensional plot, in decibels (dB), of the ratio of the desired electric-field polarization to the undesired electric field polarization of the combined signal radiated by the antenna element, bias line, and polarization-compensation line of FIG. 8, according to an embodiment.

FIG. 10 is a three-dimensional plot 90 of the polarization pattern of the total transmit signal that the primary radiators (antenna element 12, bias line 32, compensation line 72) of the antenna cell 70 (FIG. 8) radiate during a transmit mode. The quantity plotted is the ratio, in dB, of $$\frac{\vec{E}_{total_AZ}}{\vec{E}_{total_EL}},$$

where $\vec{E}_{total_AZ}$ is the component of the radiated total transmit signal having an electric field oriented, as desired, in the AZ direction, and where $\vec{E}_{total_EL}$ is the component of the radiated total transmit signal having an electric field oriented, as is undesired, in the EL direction.

A comparison of the plot 90 to the plot 62 (FIG. 5) shows that adding the compensation line 72 to the antenna unit 24 (FIG. 2) to form the antenna unit 70 (FIG. 8) configures the antenna unit 70 to generate a radiation pattern having a level of cross-polarization that is similar to the level of cross-polarization of the radiation pattern generated by the antenna element 12 in the absence of the bias line 32 and the compensation line 72.

Figure 11:
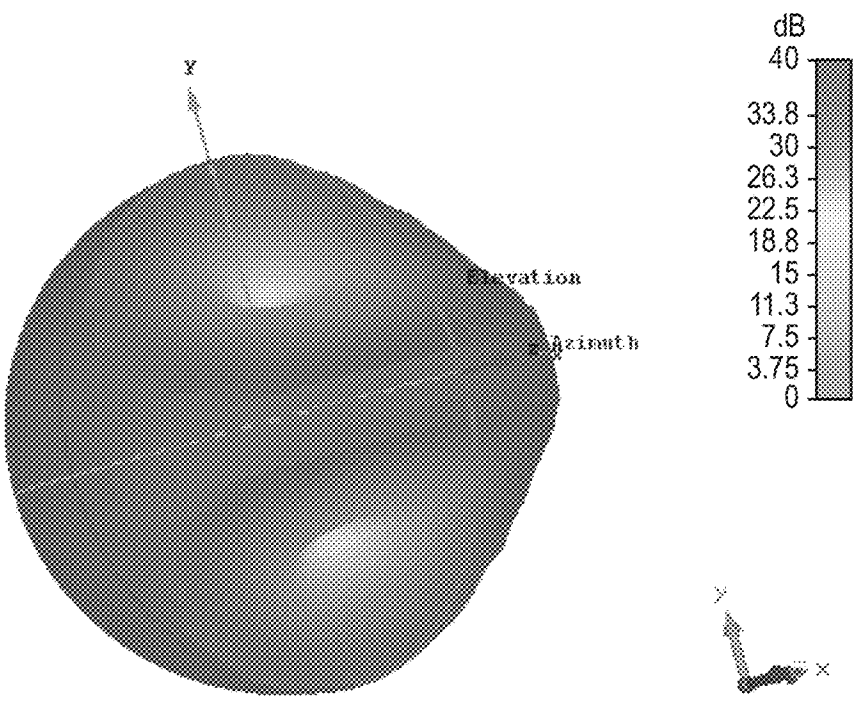
FIG. 11 is three-dimensional plot, in decibels relative to isotropic (dBi), of the gain of the combined signal radiated by the antenna element, bias line, and polarization-compensation line of FIG. 8, according to an embodiment.

FIG. 11 is three-dimensional plot 100 of the normalized directivity, in dB relative to isotropic (dBi), of the sum of the powers of the two total-signal components radiated by the primary radiators (antenna element 12, bias line 32, compensation line 72) of the antenna unit 70 (FIG. 8) and having electric fields orientated in the AZ and EL directions, respectively, according to an embodiment.

Referring to FIGS. 8-11, alternate embodiments of the antenna unit 70 are contemplated. For example, one or more of the antenna element 12, bias line 32, iris 46, and compensation line 72 can have any suitable dimensions and shapes. Furthermore, one or more of the number, spacing, placement, and sizes of the isolation vias 20 can have any suitable values. Moreover, alternate embodiments described elsewhere in conjunction with FIGS. 1-7 and 12-24 may apply to the antenna unit 70 of FIGS. 8-11.

Referring again to FIG. 8, and as described above in conjunction with FIGS. 1-3, the total transmitted RF signal radiated by the radiators (antenna element 12, bias line 32, lumped circuit element 36 (for example a diode), compensation line 72) of the antenna unit 70 can cause one or both of the DC bias via 34 and the compensation via 74 to radiate RF energy.

Because the vias 34 and 74 form walls of the underlying waveguide 26 (see, e.g., FIG. 3), RF energy radiated by these vias could excite unwanted signal-propagation modes in the underlying waveguide 26. Furthermore, currents induced in the bias via 34 by the radiated total transmit RF signal, or voltages induced by these currents, can damage the circuitry (not shown in FIG. 8) configured to generate the DC active voltage or the DC inactive voltage on the bias via.

A technique for reducing or eliminating the currents induced in the bias and compensation vias 34 and 74 by the total transmit RF signal radiated by the antenna unit 70 is to include an RF choke (not shown in FIG. 8) between the bias line 32 and the bias via 34, and another RF choke between the compensation line 72 and the compensation via 74.

Unfortunately, the space required by such RF chokes in the antenna layer (e.g., a conductive or metal layer), in which are disposed the antenna element 12, bias line 32, and compensation line 72, can increase the footprint of the antenna unit 70, and, therefore, can increase the size of the antenna of which the antenna unit forms a part. And such an increase in footprint may render the antenna unsuitable for one or more applications.

Another technique for reducing or eliminating the currents induced in the bias and compensation vias 34 and 74 by the total transmit RF signal radiated by the antenna unit 70 is to include a bypass capacitor (not shown in FIG. 8) between the bias via 34 and the grounded conductor plane 38 (FIGS. 1, 3, and 8) surrounding the antenna element 12 (the conductor plane to which the isolation vias 20 are coupled), and another bypass capacitor between the compensation via 74 and the grounded conductor plane.

Unfortunately, as described above regarding the RF chokes, the space required by such bypass capacitors in the antenna layer in which are disposed the antenna element 12, bias line 32, and compensation line 72 may increase the footprint of the antenna unit 70, and, therefore, may increase the size of the antenna of which the antenna unit forms a part.

Figure 12:
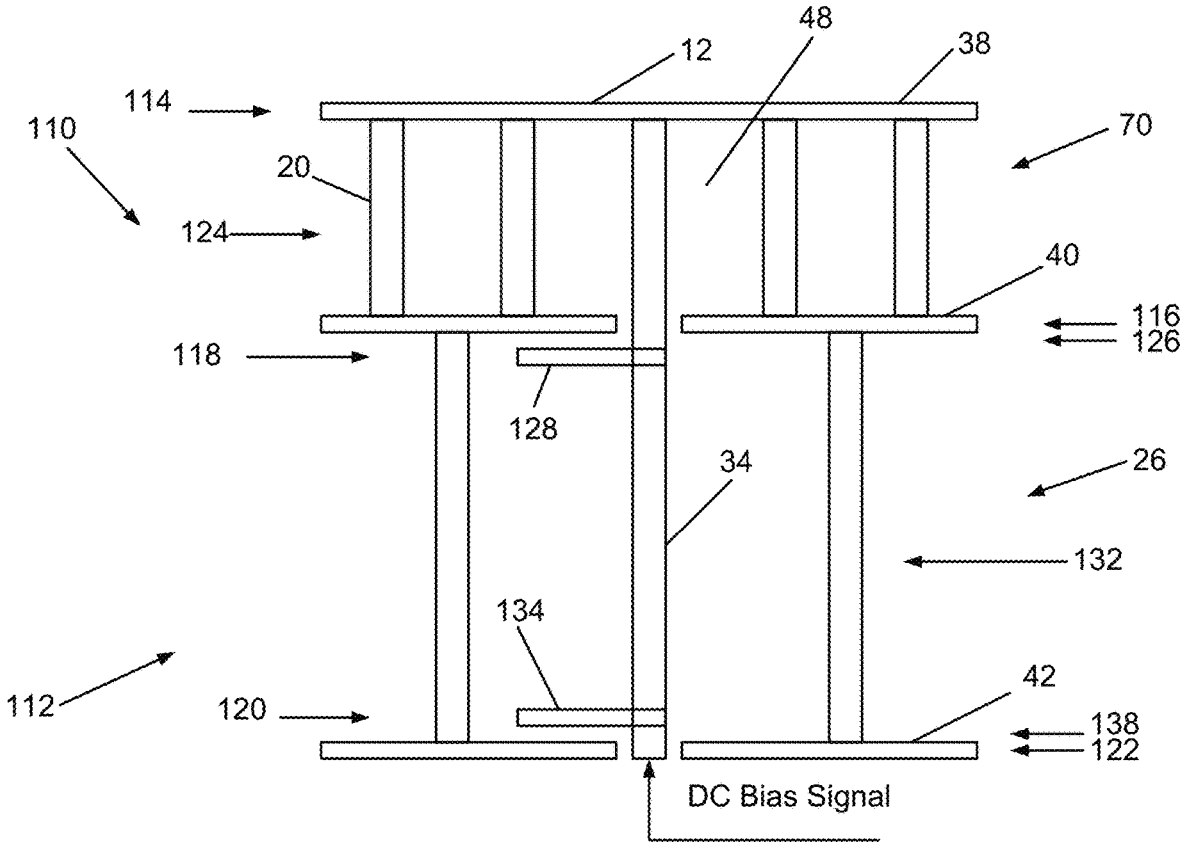
FIG. 12 is a side view of an antenna unit and an underlying transmission medium that includes RF bypass stubs, according to an embodiment.

FIG. 12 is a side view, taken along lines B-B' of FIG. 8, of a portion 110 of an antenna 112 that includes the antenna unit 70 and the underlying waveguide 26 of FIG. 8, according to an embodiment in which the antenna portion includes bypass stubs that are configured to reduce or eliminate the amount of RF energy radiated by the bias and compensation vias 34 and 74, and which are configured to reduce or eliminate RF-induced voltages and currents in the bias and compensation vias.

Figure 13:
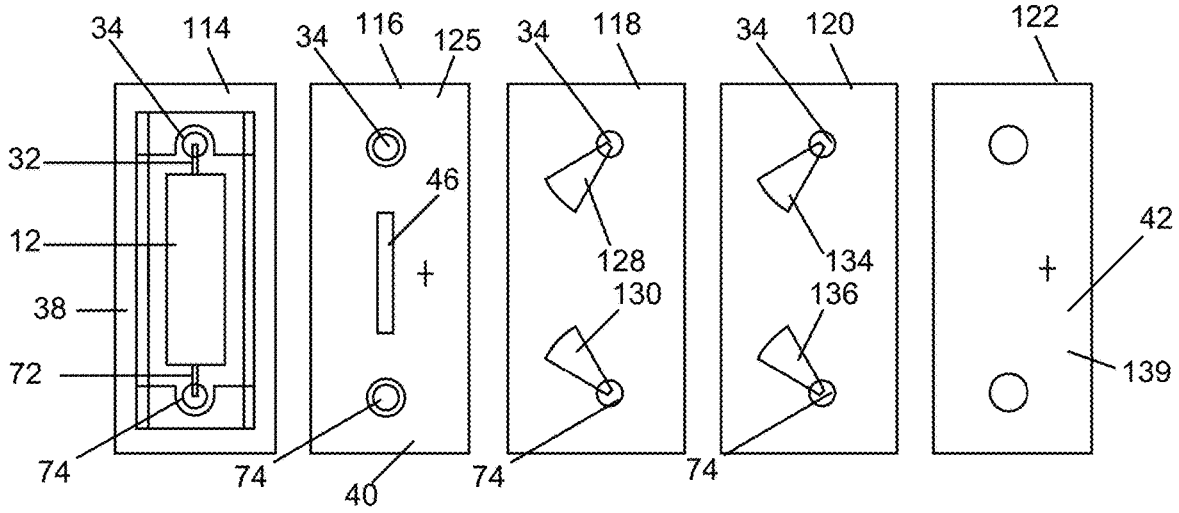
FIG. 13 is a diagram of conductive layers of the antenna unit and the underlying transmission medium of FIG. 12, according to an embodiment.

FIG. 13 is a diagram, in plan view, of each of the conductive (metal) layers 114, 116, 118, 120, and 122 that form the antenna portion 110 of FIG. 12, according to an embodiment.

In FIGS. 12-13, components common to FIGS. 2, 4, 8, and 12-13 are referenced with the same reference numbers. Furthermore, although the circuit element 36 (e.g., FIG. 8) is omitted from FIGS. 12-13, it is understood that the circuit element (e.g., a diode) is present in the antenna unit 70.

Referring to FIGS. 12 and 13, the antenna element 12, bias line 32, and polarization-compensation line 72 are formed in the first conductive layer 114, and respective first ends of the bias via 34 and of the compensation via 72 are exposed in the first conductive layer.

Disposed between the first conductive layer 114 and the second conductive layer 116 is an insulating (non-conductive) core layer 124, which is formed from a material having a low-loss tangent (i.e., a low value of the ratio of the Real ($R_e$) component of the material's dielectric constant to the Imaginary (Im) component of the material's dielectric constant) and having a low and variable $R_e$ impedance component to allow turning "on" and turning "off" the antenna cell 70 as described above in conjunction with FIGS. 1-3. Furthermore, the region 48 underlying the antenna element 12 is disposed in, and formed from, the core layer 124, and the bias and compensation vias 34 and 74 pass through the core layer. For example, the core layer 124 can have a thickness of approximately sixty thousandths of an inch (i.e., sixty mils), and can be formed from a weave of PTFE (Teflon®) and glass with a ceramic filler between the weave voids, where one or more characteristics (e.g., composition, dimensions, density) of the ceramic filler can be set to tune the $R_e$ component of the core layer's impedance to a desired value.

The second conductive layer 116 includes an RF ground plane 125 that forms the ceiling 40 of the waveguide 26, that defines the iris 46, and through which the bias and compensation vias 34 and 74 pass.

Between the second conductive layer 116 and the third conductive layer 118 is an insulating (non-conductive) pre-impregnated (i.e., pre-preg) layer 126, which, for example, is formed from a suitable epoxy compound and is approximately four mils thick.

The third conductive layer 118 includes conductive bypass stubs 128 and 130, which are respectively coupled to the portions of the bias and compensation vias 34 and 74 disposed in the third conductive layer (the bias and compensation vias pass through the third conductive layer).

The bypass stubs 128 and 130 are configured to cause RF energy flowing in the bias and compensation vias 34 and 74, respectively, to bypass the inner portion of the waveguide 26 by causing such RF energy to flow through the pre-preg layer 126 to the RF ground plane 125 in the second conductive layer 116. Each stub 128 and 130 is configured to form, with the pre-preg layer 126, a respective series-resonant circuit having a resonant frequency approximately equal to the frequency of the row-reference signal that propagates through the waveguide 26. For RF signals flowing in the vias 34 and 74 and having a frequency at or near the resonant frequency of this effective series-resonant circuit, the combination of each stub 128 and 130 and the pre-preg layer 126 provides a low-impedance path between the respective via 34 and 74 and the RF ground plane 125. Furthermore, each stub 128 and 130 is radially tapered and has a circular-arc end to lower the quality (Q) factor of the stub/pre-preg-layer combination such that the combination provides a relatively low bypass impedance over a relatively wide frequency band that is centered about the combination's resonant frequency. Moreover, because the stubs 128 and 130 are disposed in an internal conductive layer 118 inside of the waveguide 26 instead of in the upper conductive layer 114, the stubs neither increase the footprint of the antenna 112 nor increase the integration density of the upper conductive layer, but do reduce losses in the waveguide by allowing the waveguide to be made wider (the width of the waveguide can be dependent on the integration density of the upper conductive layer; hence, the lower the integration density of the first conductive layer, the wider the waveguide can be). In addition, because the thickness of the pre-preg layer 126 is on the order of a few mils, the electromagnetic fields generated by the stubs 128 and 130, at or near the resonant frequency of the stub/pre-preg combination, are tightly confined within the region of the pre-preg layer between the respective stub and the ground plane 125 in the second conductive layer 116, even for a resonant frequency upwards of 100 GHz. Such tight confinement of the electromagnetic fields can minimize spurious radiation and unintended coupling paths, and can render the bypass characteristics of the stub/pre-preg combinations more dependent on the shape and dimensions of the stubs 128 and 130, and less dependent on the thickness of the pre-preg layer 126. Therefore, such tight confinement of the electromagnetic fields can render the bypass characteristics of a stub/pre-preg combination relatively insensitive to variations in the thickness of the pre-preg layer 126, even where the stubs 128 and 130 are disposed inside of the waveguide 26. Such reduced dependence of the bypass characteristics on the thickness of the pre-preg layer 126 can be advantageous because, in at least some manufacturing processes, the dimensions of the bypass stubs 128 and 130 can be formed with higher precision than can the thickness of the pre-preg layer.

Between the third conductive layer 118 and the fourth conductive layer 120 is a second insulating (non-conductive) core layer 132, which can be formed from a material (e.g., a dielectric material) that is similar to the material from which the core layer 124 is formed. Because the second core layer 132 forms the bulk of the inside of the waveguide 26, the electromagnetic-signal-influencing characteristics of the material from which the second core layer is formed can be tuned to provide the waveguide with desired signal-carrying characteristics.

The fourth conductive layer 120 includes additional bypass stubs 134 and 136, which are coupled to the bias and compensation vias 34 and 74, respectively. For example, the stubs 134 and 136 are similar in dimensions, function, and orientation, as the bypass stubs 128 and 130 disposed in the third conductive layer 118.

Between the fourth conductive layer 120 and the fifth conductive layer 122 is an insulating (non-conductive) pre-impregnated (i.e., pre-preg) layer 138, which, for example, is similar in composition, thickness, and function to the pre-preg layer 126.

The stubs 134 and 136 are configured to cause RF energy flowing in the bias and compensation vias 34 and 74, respectively, to bypass the inner portion of the waveguide 26 by causing such RF energy to flow through the pre-preg layer 138 to an RF ground plane 139 in the fifth conductive layer 122. Each stub 134 and 136 is configured to form, with the pre-preg layer 138, a respective series-resonant circuit having a resonant frequency approximately equal to the frequency of the row-reference signal that propagates through the waveguide 26. For RF signals flowing in the vias 34 and 74 and having a frequency at or near the resonant frequency of this series-resonant circuit, the combination of the stub and pre-preg layer provides a low-impedance path between the respective via 34 and 74 and the RF ground plane 139. Furthermore, each stub 134 and 136 is radially tapered and has a circular-arc end to lower the Q factor of the respective stub/pre-preg-layer combination such that the combination provides a relatively low bypass impedance over a relatively wide frequency band that is centered about the respective stub/pre-preg-layer combination's resonant frequency. Because the stubs 134 and 136 are disposed in an internal conductive layer 118 inside of the waveguide 26 instead of in the upper conductive layer 114, the stubs neither increase the footprint of the antenna 112 nor increase the integration density of the upper conductive layer, but do reduce losses in the waveguide by allowing the waveguide to be wider. Furthermore, because the thickness of the pre-preg layer 138 is on the order of a few mils, the electromagnetic fields radiated by the stubs 134 and 136, at or near the resonant frequency of the respective stub/pre-preg combination, are tightly confined within the region of the pre-preg layer between the respective stub and the ground plane 139 in the fifth conductive layer 122, even for a resonant frequency upwards of 100 GHz. Such tight confinement of the electromagnetic fields can minimize spurious radiation and unintended coupling paths, and can render the bypass characteristics of the stub/pre-preg combinations more dependent on the shape and dimensions of the stubs 134 and 136, and less dependent on the thickness of the pre-preg layer 138. Therefore, such tight confinement of the electromagnetic fields can render the bypass characteristics of a stub/pre-preg combination relatively insensitive to variations in the thickness of the pre-preg layer 138, even where the stubs 134 and 136 are disposed inside of the waveguide 26. Such reduced dependence of the bypass characteristics on the thickness of the pre-preg layer 138 can be advantageous because, in at least some manufacturing processes, the dimensions of the bypass stubs 134 and 136 can be formed with higher precision than can the thickness of the pre-preg layer.

The fifth conductive layer 122 is configured to form the floor 42 of the waveguide 26, and to allow coupling of the bias via 34 to circuitry (not shown in FIGS. 12-13) configured to generate the DC active and DC inactive voltages for turning the antenna element 12 "on" and "off," respectively. Because the compensation via 74 is configured to float electrically at DC, it is not coupled to any voltage source or ground.

Still referring to FIGS. 12-13, operation of the portion 110 of the antenna 112 is described in both transmit and receive modes while the antenna unit 70 is activated (the antenna unit is activated when its antenna element 12 is activated), according to an embodiment.

During a transmit mode, a row-reference signal propagates through the waveguide 26, from left to right in FIG. 12.

As described above in conjunction with FIGS. 1-3 and 8, the iris 46 generates, in response to the row-reference signal, an iris signal having the same frequency, but a lower power, than the row-reference signal, and the region 48 of the antenna cell 70 couples the iris signal to the antenna element 12 by forming a resonating circuit with the antenna element.

In response to the iris signal, the antenna element 12 radiates an elemental signal, a portion of which propagates outward from the antenna element.

Any RF signals coupled to, or otherwise induced in, the bias via 34 flow through one or both of the bias stub 128/pre-preg layer 126 combination and the bias stub 134/pre-preg layer 138 combination to the respective RF ground conductor 125 and 129 in the second and fifth conductive layers 116 and 122 as described above. Bypassing such RF signals before they can propagate to the portion of the bias via 34 that forms a wall of the waveguide 26 allows the stub 128/pre-preg-layer 126 combination and the stub 134/pre-preg-layer 138 combination to reduce or to eliminate one or more of the unwanted effects (e.g., exciting an unwanted signal-propagation mode) that such RF signals otherwise could have on the operation of the waveguide. And in bypassing such RF signals before they can propagate to the circuitry (not shown in FIGS. 12-13) configured to generate the DC active and DC inactive voltages, the stub 128/pre-preg-layer 126 combination and the stub 134/pre-preg-layer 138 combination reduce or eliminate the possibility that such RF signals can damage or destroy such circuitry.

Similarly, any RF signals coupled to, or otherwise induced in, the compensation via 74 flow through one or both of the bias stub 128/pre-preg-layer 126 combination and the bias stub 134/pre-preg-layer 138 combination to the respective RF ground conductors 125 and 139 as described above. In bypassing such RF signals before they can propagate to the portion of the compensation via 74 that forms a wall of the waveguide 26, the stub 128/pre-preg-layer 126 combination and the stub 134/pre-preg-layer 138 combination reduce or eliminate one or more of the unwanted effects (e.g., exciting an unwanted signal-propagation mode) that such RF signals otherwise could have on the operation of the waveguide.

During a receive mode, any RF signals coupled to, or otherwise induced in, the bias via 34 or the compensation via 74, flow through one or more of the four bias-stub/pre-preg-layer combinations to the respective RF ground conductors 125 and 139 in a manner similar to that described above in conjunction with the transmit mode, to achieve results similar to those described above in conjunction with the transmit mode.

Still referring to FIGS. 12-13, alternate embodiments of the antenna portion 110 of the antenna 112 are contemplated. For example, the antenna portion 110 may include only one bypass stub 128 and 134 per the DC bias via 34, and only one other bypass stub 130 and 136 per the compensation bias via 74, and these included stubs may occupy the same one of the conductive layers 118 and 120, or may occupy different ones of these conductive layers. Furthermore, one or more of the bypass stubs 128, 130, 134, and 136 can have any suitable shape, dimensions, and orientation different from the shapes, dimensions, and orientations described above in conjunction with, and shown in, FIGS. 12-13. Moreover, instead of being disposed inside of the waveguide 26, the stubs 128, 130, 134, and 136, and the pre-preg layers 126 and 138, can be disposed just outside of the waveguide, i.e., just above the conductive layer 116 and just below the conductive layer 122, respectively. In addition, alternate embodiments described elsewhere in conjunction with FIGS. 1-11 and 14-24 may apply to the antenna portion 110 of FIGS. 12-13.

Figure 14:
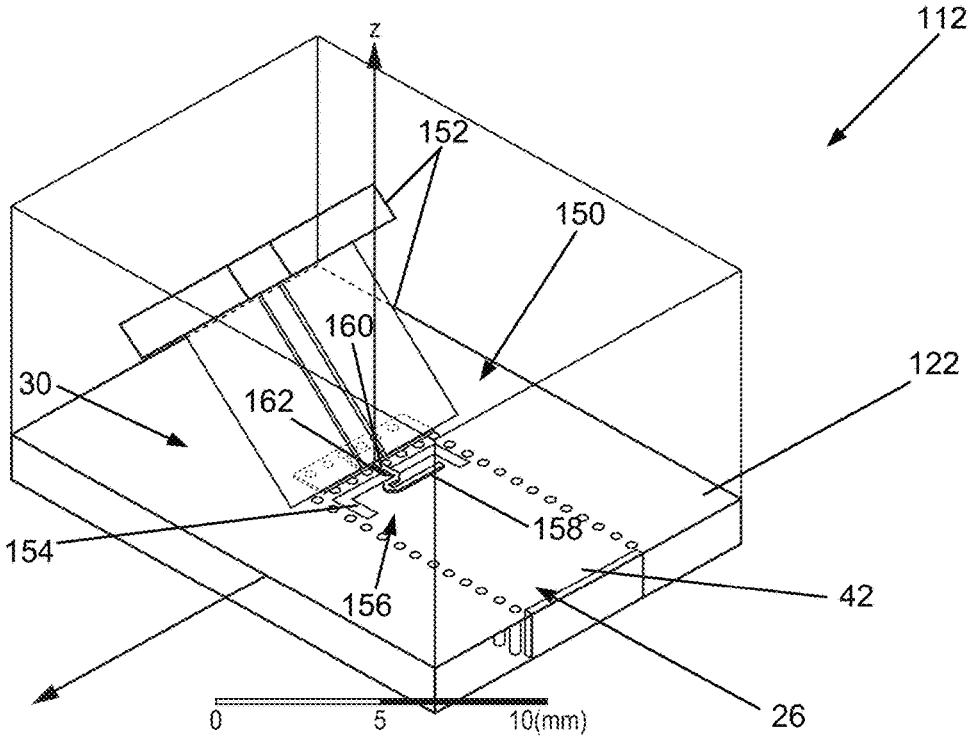
FIG. 14 is an isometric view of an impedance-termination structure disposed at an end of a transmission medium corresponding to a row of antenna units of a beam-steering antenna, and of a test probe coupled to the impedance-termination structure, according to an embodiment.

FIG. 14 is an isometric view of a portion of the conductive layer 122 and the floor 42 of the waveguide 26 of FIG. 12, of an impedance structure 150 disposed at the back end 30 (see, e.g., FIG. 1) of the waveguide, and of a signal probe 152 coupled to the impedance structure, according to an embodiment.

Figure 15:
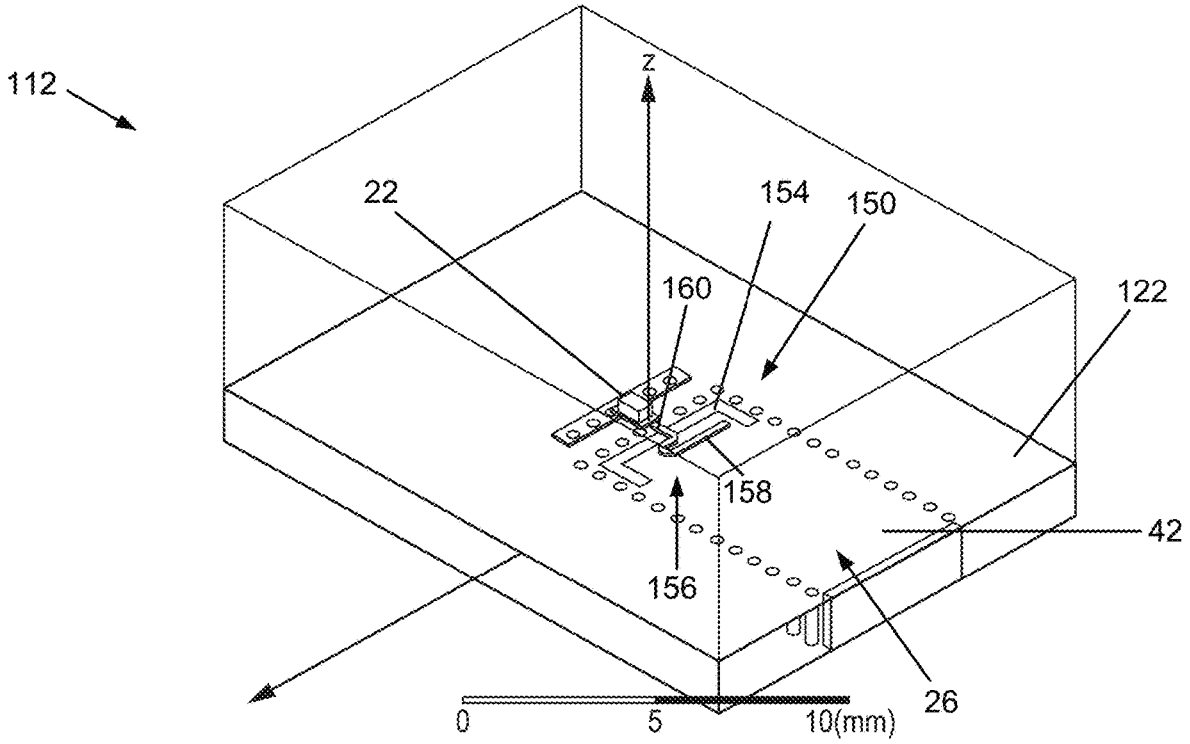
FIG. 15 is an isometric view of an impedance-termination structure disposed at an end of a transmission medium corresponding to a row of antenna units of a beam-steering antenna, and of a termination impedance coupled to the impedance-termination structure, according to an embodiment.

FIG. 15 is an isometric view of the portion of the conductive layer 122 and the floor 42 of the waveguide 26 of FIG. 14, of the impedance structure 150 disposed at the back end 30 (see, e.g., FIG. 1) of the waveguide, and of the termination impedance 22 (FIG. 1) coupled to the impedance structure, according to an embodiment.

Referring to FIGS. 14-15, the impedance structure 150 is configured to allow probing of the waveguide 26 during manufacturing testing, and during other testing, without the need for a complex and bulky connector, and is configured to facilitate installation of the termination impedance 22 after such testing is complete. Furthermore, although the impedance structure 150 for only one waveguide 26 is shown and described, it is understood that the impedance structures for the other waveguides of the antenna 112 can be similar to the impedance structure 150.

The impedance structure 150 includes a squared-U-shaped slot 154 and a microstrip 156 having a first portion 158, which is approximately parallel to the long portion of the slot and that is approximately km/4 long (km is the wavelength of the row-reference signal that the waveguide 26 is configured to carry), and a second portion 160, which is approximately perpendicular to the first portion and spans the center of the slot. The slot 154 and microstrip 156 are configured to form an aperture-coupled waveguide-to-microstrip transition that has a relatively small lateral footprint. At the frequency of the row-reference signal propagating in the waveguide 26, the microstrip 156 is configured to have approximately zero impedance such that the back end 30 of the waveguide "sees" only the impedance of the component (e.g., the probe 152, the termination impedance 22) coupled to an end 162 of the second portion 160 of the microstrip, and such that the component "sees" only the impedance of the waveguide. Therefore, to prevent unwanted signal reflections within the waveguide 26, the component coupled to the impedance-structure end 162 has approximately the same impedance (e.g., 50Ω) as the characteristic impedance (e.g., 50Ω) of the waveguide.

Operation of the impedance structure 150 is described during testing, transmit mode, and receive mode, and manufacturing of the antenna 112 is described, according to an embodiment.

During testing, a human tester, or a test machine, positions the probe 152 such that the probe is electrically coupled to the end 162 of the termination structure 150, and causes a test row-reference signal to propagate in the waveguide 26 toward the back end 30. For example, the probe 152 can be a 575-800 micron (μm) pitch ground-signal-ground (GSG) probe having a 508 μm nominal L6 gap ground-center and configured for >10 dB return loss for in-line production testing.

The probe 152 presents to the waveguide 26, via the impedance structure 150, an impedance approximately equal to the characteristic impedance of the waveguide such that the back end 30 of the waveguide redirects few or no components of the row-reference signal in a direction away from the back end. That is, the probe 152 presents to the waveguide 26 an impedance that results in few, if any, redirections of the row-reference signal back up the waveguide.

The portion of the row-reference signal received by the probe 152 is analyzed by a test circuit or other tool (not shown in FIGS. 14-15) for the purpose of determining whether the waveguide 26, or any associated components or structures of the antenna 112, are defective.

After testing is complete, the manufacturer installs the termination impedance 22 at the end 162 of the impedance structure 150.

During transmit and receive modes of operation after the termination impedance 22 is installed, the termination impedance presents to the waveguide 26, via the impedance structure 150, an impedance approximately equal to the characteristic impedance of the waveguide such that the back end 30 of the waveguide redirects few or no components of the row-reference signal in a direction away from the back end of the waveguide. That is, the termination impedance 22 presents to the waveguide 26 an impedance that results in few, if any, redirections of the row-reference signal back up the waveguide.

Still referring to FIGS. 14-15, alternate embodiments of the impedance structure 150 are contemplated. For example, one or more of the slot 154 and microstrip 156 can have any suitable shape, dimensions, locations, and orientation different from the shapes, dimensions, locations, and orientations described above in conjunction with, and shown in, FIGS. 14-15. In addition, alternate embodiments described elsewhere in conjunction with FIGS. 1-13 and 16-24 may apply to the impedance structure 150, and one or more other structures, of FIGS. 14-15.

Figure 16:
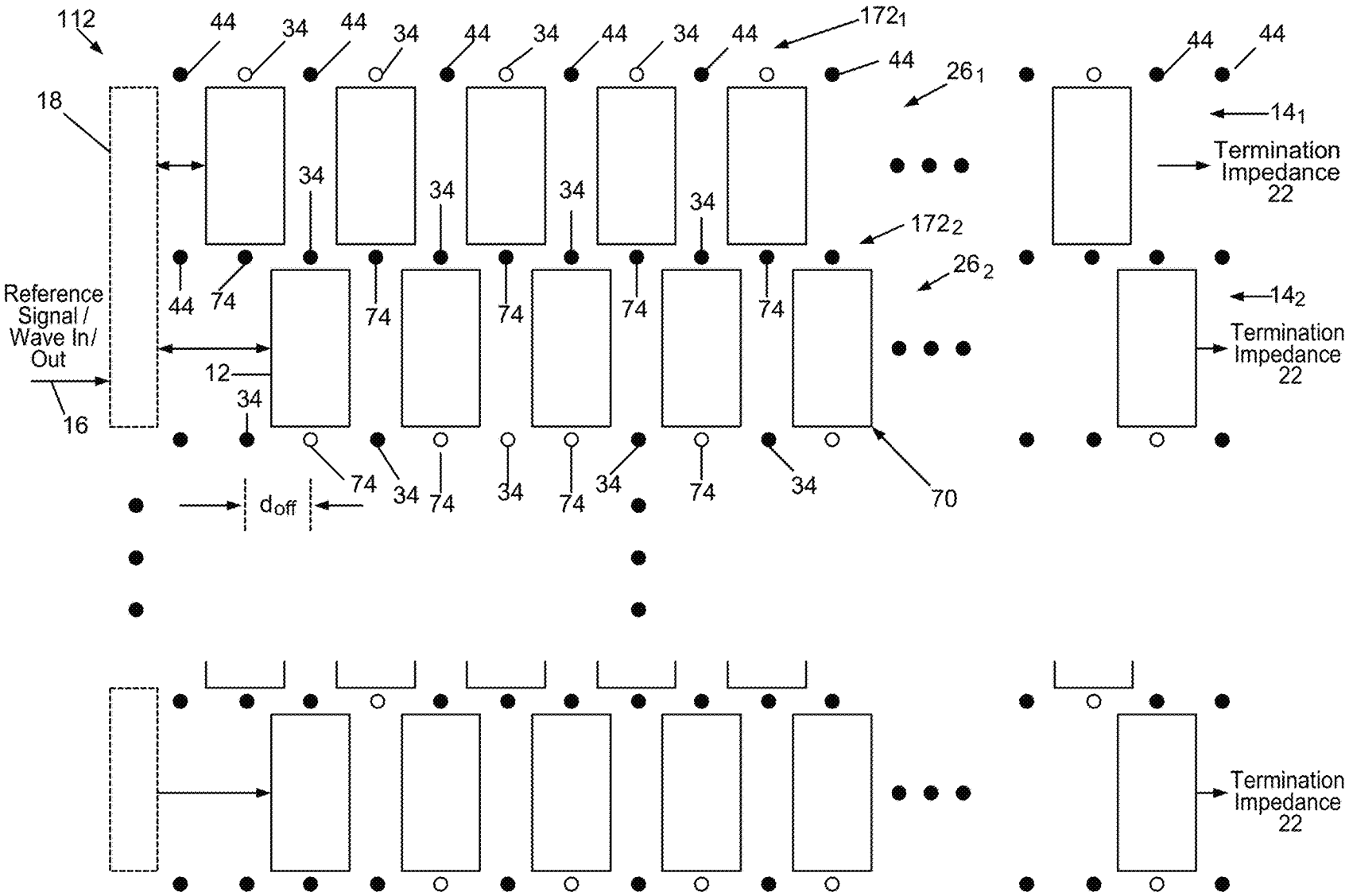
FIG. 16 is a diagram, in plan view, of a beam-steering antenna in which antenna units in adjacent rows are offset relative to one another, and in which waveguides of respective adjacent rows of antenna units share a respective same conductive wall, according to an embodiment.

FIG. 16 is a diagram, in plan view, of the antenna 112 having waveguides $\mathbf{26}_1$-$\mathbf{26}_n$ that share side walls $\mathbf{172}_2$-$\mathbf{172}_{m-1}$, where the antenna units 70 in one row 14 are offset relative to the antenna units in an adjacent row such that the DC bias vias 34 and the compensation bias vias 74 can be centered relative to their respective antenna elements 12, according to an embodiment. And according to a further embodiment, the DC bias vias 34 and the compensation bias vias 74 are sized such these vias are the majority of vias that form the sidewalls 172. Furthermore, components common to the antenna 10 of FIG. 1 and the antenna 112 of FIG. 16 share the same respective reference numbers. Moreover, for clarity, the bias lines 32 and the polarization-compensation lines 72 (FIGS. 8 and 13) are omitted from FIG. 16, as are the isolation vias 20. The only vias shown in FIG. 16 are the sidewall vias 44, the DC bias vias 34, and the polarization-compensation vias 74, which are the vias that form the waveguide sidewalls 172.

Unlike the waveguides 26 of FIGS. 1-3, which each include respective sidewalls formed from respective rows of sidewall vias 44, each pair of adjacent waveguides 26 of FIG. 16 share a respective sidewall 172, thus reducing the number of sidewall vias in the antenna 112, and thus allowing a reduction in the width (top-to-bottom dimension in FIG. 16) of the antenna. For example, the waveguide $\mathbf{26}_1$ shares a sidewall $\mathbf{172}_2$ with the waveguide $\mathbf{26}_2$.

Reducing the number of sidewall vias 44 can reduce the complexity and cost of manufacturing the antenna 112 by, for example, extending the lifetimes of the drill bits used to drill the DC bias vias 34, the sidewall vias 44, and the compensation vias 74.

Further unlike the antenna units 70 of FIGS. 1-3, the antenna units 70 of FIG. 16 in one row 14 are offset by a distance $d_{off}$ relative to the antenna units in immediately adjacent rows 14. The distance $d_{off}$ is such that the centers of the antenna elements 12 in one row 14 are aligned with the half-way line between adjacent antenna elements in an adjacent row 14.

Such an offset allows adjacent waveguides 26 to share sidewalls, and also allows the DC bias vias 34 and the compensation bias vias 74 to be centered relative to the corresponding antenna elements such that the cross-polarization compensation that the bias lines 32 (FIG. 8) afford is not degraded. For example, the side wall $\mathbf{172}_2$ of vias includes the DC bias vias 34 for the antenna elements 12 in the row $\mathbf{14}_2$, and includes the compensation vias 74 for the antenna elements in the row $\mathbf{14}_1$.

Furthermore, by sizing the bias and compensation vias 34 and 74 appropriately (e.g., by increasing the sizes, e.g., the cross-section diameters, of the bias and compensation vias relative to their sizes in the antenna 10 of FIG. 1), the shared waveguide side walls 172 can be formed from the vias 34 and 74 almost exclusively; sidewall vias 44 may be needed in only a few locations, like at the ends of the side walls 172, and in the first and last side walls 172 (the top and bottom side walls in FIG. 16). This further reduces the number of vias in the antenna 112, and also increases the aspect ratios of the vias 34 and 74, thus making the corresponding via openings easier to fill with an electrically conductive material such as a metal while avoiding formation of voids (e.g., gas bubbles) in the formed vias.

The waveguides 26 sharing sidewalls 172 made almost exclusively from DC bias vias 34 and compensation bias vias 74 typically does not adversely affect the operation of the antenna 112.

Still referring to FIG. 16, alternate embodiments of the antenna 112 are contemplated. For example, a side wall 172 can include only DC bias vias 34, and another side wall 172 can include only compensation bias vias 74. Furthermore, DC bias vias 34 and compensation bias vias 74 for a particular row 14 of antenna units 70 can be in the same row 172 of sidewall vias. Further in example, although the sidewall row $\mathbf{172}_2$ is described as including DC bias vias 34 only for the antenna elements 12 in the row $\mathbf{14}_2$ and including compensation bias vias 74 only for the antenna elements in the row $\mathbf{14}_1$, the sidewall row $\mathbf{172}_2$ could include DC bias vias for antenna elements in both of the rows $\mathbf{14}_1$ and $\mathbf{14}_2$, or could include compensation bias vias for antenna elements in both of the rows $\mathbf{14}_1$ and $\mathbf{14}_2$. Moreover, alternate embodiments described elsewhere in conjunction with FIGS. 1-15 and 17-24 may apply to the antenna 112 of FIG. 16.

Described in conjunction with FIGS. 17-21 is an embodiment of the antenna 112 configured such that the elemental signals radiated by the antenna elements 12 in a row 14 of antenna units 70 each have approximately the same power level. As described above, as a transmit row-reference signal propagates down a waveguide 26, the amplitude and the power level of the transmit row-reference signal decay exponentially due primarily to signal power lost due to coupling of the transmit row-reference signal to the antenna elements 12 via the irises 46 and to losses in the waveguide. Consequently, if all of the antenna units 70 and irises 46 are the same regardless of their positions within the row 14, then the amount of power radiated by each antenna element 12 also decays exponentially from the front end 28 of the waveguide 26 to the back end 30 of the waveguide during a transmit mode. During a receive mode, a similar phenomenon occurs in that the signal components that form a receive row-reference signal do not have a uniform power at the input/output port 16 (e.g., FIG. 16); the signal components generated by antenna elements 12 far from the input output/port tend to have lower powers than the signal components generated by antenna elements closer to the input/output port.

Figure 17:
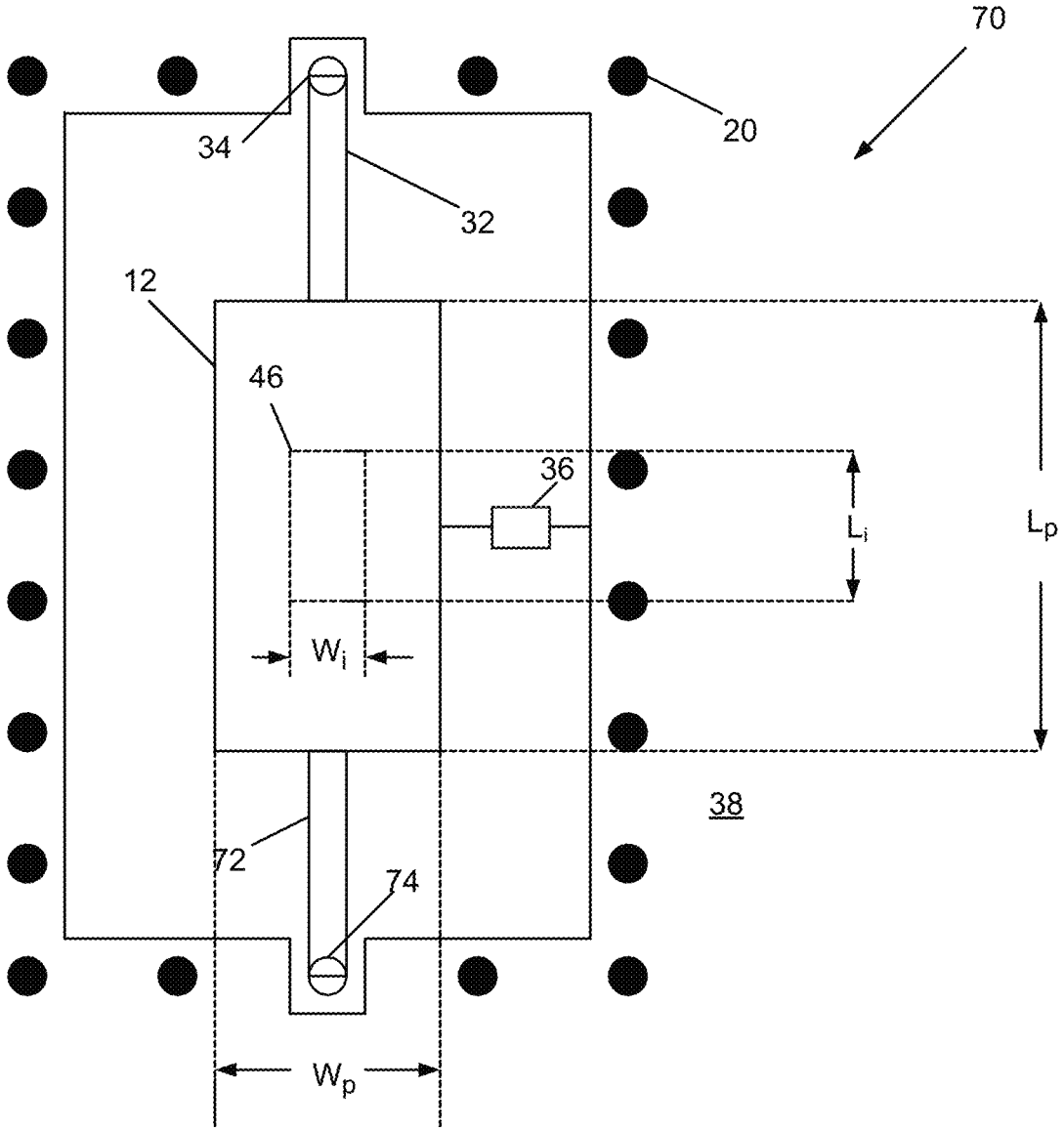
FIG. 17 is a diagram, in plan view, of an antenna unit of a beam-steering antenna, according to an embodiment.

FIG. 17 is a diagram, in plan view, of an antenna unit 70 of an antenna 112, with the dimensions of the antenna element 12 and the iris 46 dependent on the position of the antenna unit within a row of antenna elements, according to an embodiment.

Figure 18:
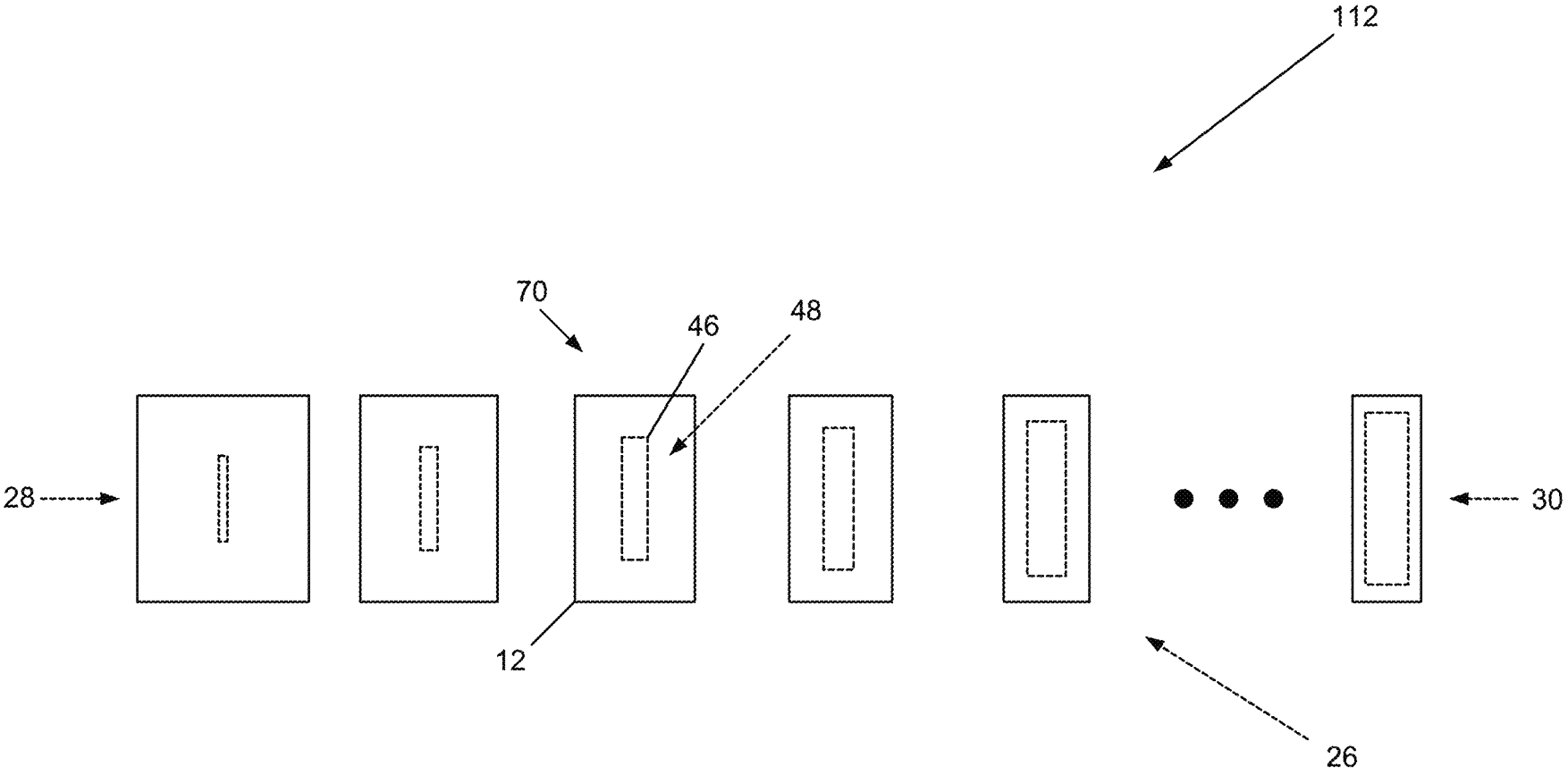
FIG. 18 is a diagram, in plan view, of an antenna including at least one row of antenna units with antenna elements and irises having different sizes depending on position of the antenna unit in the row, according to an embodiment.

FIG. 18 is a diagram, in plan view, of a row 14 of antenna units 70 with antenna elements 12 and irises 46 having sizes depending on the antenna units' positions in the row such that each of the activated antenna elements radiates a respective elemental signal having approximately the same power during a transmit mode, according to an embodiment. And during a receive mode, the respective elemental signals received by the antenna elements 12 effectively have approximately the same power at the input/output port 16 (e.g., FIG. 16). For clarity, the bias lines 32, bias vias 34, compensation lines 72, and compensation vias 74 are omitted from FIG. 18.

Referring to FIGS. 17-18, to counteract the exponential decay of the transmit row-reference signal as it propagates along the waveguide 26 from the front end 28 to the back end 30, the sizes of the irises 46 of the antenna units 70 increases, from the front end to the back end 30. The bigger the iris 46, the more of the row-reference signal's power that the iris couples to the corresponding antenna element 12. For example, to increase the size, i.e., area, of an iris 46, a designer can increase the iris's width $w_i$, length $L_i$, or both $w_i$ and $L_i$.

But if the size of an iris 46 of an antenna unit 70 is changed, then the resonant frequency of the activated combination of the antenna element 12, diode 36, and underlying region 48 (see, e.g., FIGS. 3 and 12) also changes.

One reason that it is desirable to set the resonant frequency of the activated combination of the antenna element 12, diode 36, and underlying region 48 to approximately the frequency of the row-reference signal is that because at resonance, the imaginary component Im of the impedance of the activated combination is zero, and, therefore, the phase shift that the activated combination introduces to the iris signal is zero.

It is desirable that the activated combination of the antenna element 12, diode 36, and underlying region 48 introduce little, or no, phase shift to the elemental signal relative to the row-reference signal so that all elemental signals that the antenna elements 12 radiate have, at least approximately, the same phase.

All the elemental signals having approximately the same phase can reduce the complexity of finding patterns of activated antenna elements 12 that yield desired antenna-radiation (e.g., antenna-beam) patterns.

Consequently, to maintain the resonant frequency of a combination of an antenna element 12, its diode 36, and its underlying region 48 at a desired value (e.g., the frequency of the row-reference signal) in response to a change in the size of the corresponding iris 46, a designer can change the size of the antenna element oppositely to the change in size of the iris. That is, if a designer increases the size of the iris 46, then he/she can decrease the size of the antenna element 12 to set or maintain the resonant frequency of the activated antenna-element/diode/region combination at a desired frequency. And, if a designer decreases the size of the iris 46, then he/she can increase the size of the antenna element 12 to set or maintain the resonant frequency of the antenna-element/diode/region combination at a desired frequency.

Still referring to FIGS. 17-18, because the height $L_p$ of an antenna element 12 can have a significant effect on the FOV in EL of the antenna 112, in some applications it is desirable for all antenna elements in a row to have the same height $L_p$.

Consequently, in such an application, to change the size of an antenna element 12, only the width $w_p$ of the antenna element is changed.

FIG. 18 is a diagram, in plan view, of a row 14 of antenna units 70 and the underlying waveguide 26 of an antenna 112 in which the widths $w_i$ and heights $L_i$ of the irises 46 increase, and only the widths $w_p$ of the antenna elements 12 decrease, from the front end 28 of the waveguide to the back end 30, to configure each of the antenna elements, when activated, to radiate approximately the same power during a transmit mode, according to an embodiment. The increase in the sizes of the irises 46, and the decrease in the sizes of the antenna elements 12, can be according to any suitable curve or other algorithm that yields an approximately constant power profile from one end of a row 14 to another end of the row. Furthermore, although only one row 14 of antenna units 70 and a corresponding waveguide 26 are shown, it is understood that the antenna 112 can include one or more other similar rows of antenna units and corresponding waveguides.

Figure 19:
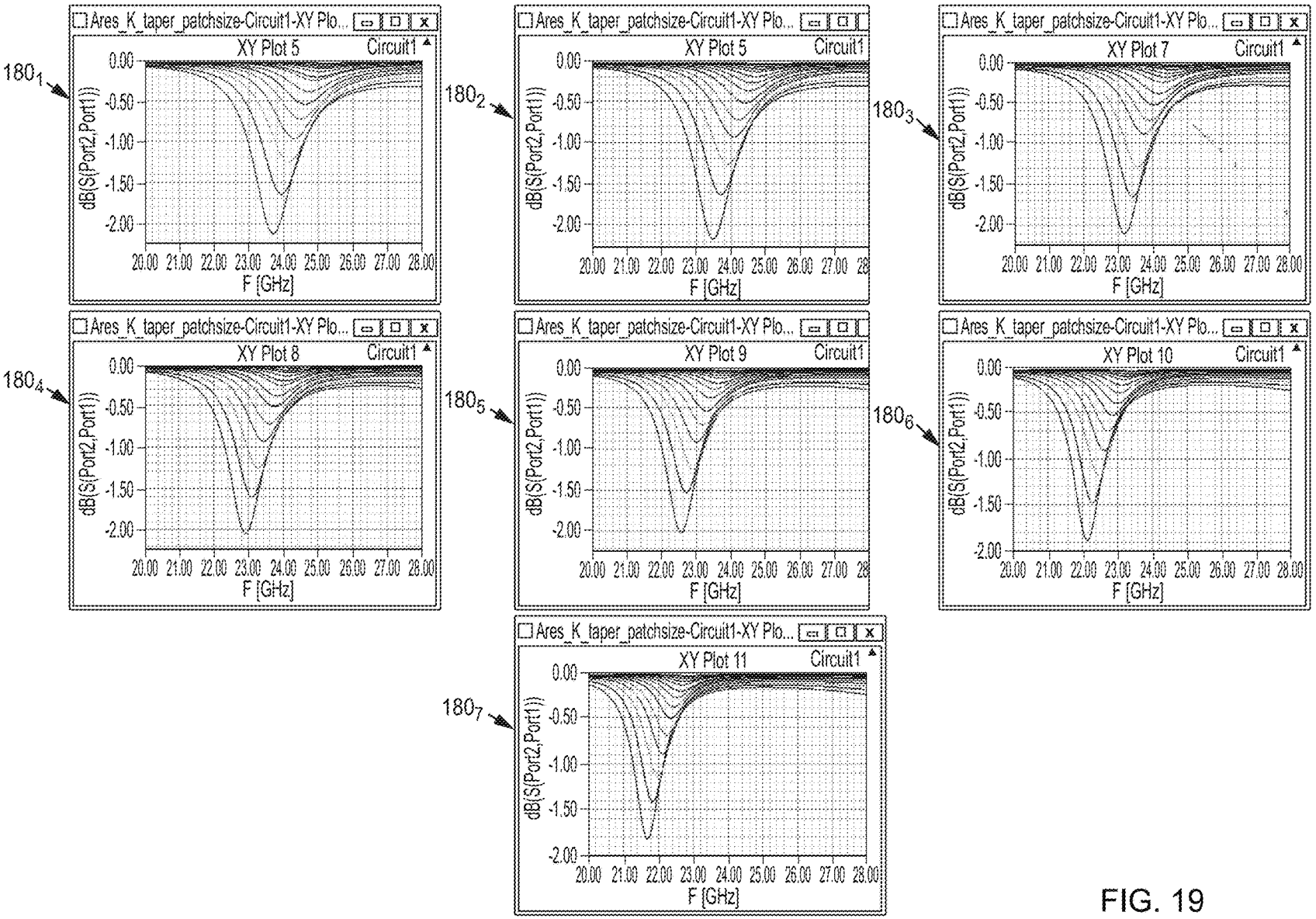
FIG. 19 includes a set of plots each showing the signal-coupling levels versus frequency of different-sized pairs of an antenna element and an iris, according to an embodiment.

FIG. 19 includes plots $\mathbf{180}_1$-$\mathbf{180}_7$ of the frequency responses of the combination of an antenna element 12, circuit element (e.g., diode) 36, and the region 48 underlying the antenna element for different sizes of the antenna element and the corresponding iris 46 (FIGS. 17-18), according to an embodiment. For the plots $\mathbf{180}_1$-$\mathbf{180}_7$, the height h (FIG. 3) between the iris 46 and the antenna element 12 is approximately $\lambda_m/4$ as described above in conjunction with FIGS. 1-3, where $\lambda_m$ is the wavelength, in the region 48 of an antenna unit 70 (e.g., FIG. 13), of the row-reference signal that the corresponding waveguide 26 is designed to carry.

Plotted along the respective y-axis of each of the plots $\mathbf{180}_1$-$\mathbf{180}_7$ is the value of the element $S_{21}$ (power transfer from input port to output port) of the well-known scattering matrix, and plotted along the x-axis is frequency in GHz. Assume that P dB is the power that the transmit row-reference signal would have at the iris 46 but for the presence of the iris, and that (P−a) dB is the power that the reference signal actually has at the iris while the antenna unit 70 (FIGS. 17-18) is activated. The quantity (P−a) dB is $S_{21}$ and is plotted on the y-axes of the plots 180. The quantity a is, therefore, the power that the iris 46 couples to the combination of the corresponding antenna element 12, diode 36, and underlying region 48. And each curve of the plots $\mathbf{180}_1$-$\mathbf{180}_7$ represents a different size N of the iris 46, where the N value increases from top to bottom of the plots, with N=28 being the topmost curve and N=60 being the bottom-most curve.

For example, the plot $\mathbf{180}_1$ is for an antenna element 12 having dimensions $L_p$=3.8 mm and $w_p$=0.8 millimeters (mm), and, from top to bottom of the plot, the curves each represent a respective size N of the iris 46 for values of N from 28 to 60. For each value of N, the length $L_i$ and the width $w_i$ of the iris 46 are given by the following equations:

$$L_i = 0.01\text{ mm} + 0.045 \cdot N\text{mm} \quad (1)$$

$$w_i = 0.01\text{ mm} + 0.01 \cdot N\text{ mm} \quad (2)$$

Furthermore, the low point (inverse peak) of each curve represents the resonant frequency of the combination of the antenna element 12, diode 36, and underlying region 48 for $L_p$=3.8 mm and $w_p$=0.8 mm and for the iris dimensions corresponding to the N value of the curve.

Still referring to FIG. 19, the plot $\mathbf{180}_2$ is for an antenna element 12 having dimensions $L_p$=3.8 mm and $w_p$=0.9 mm, and, from top to bottom of the plot, the curves each represent a respective size N of the iris 46 for values of N from 28 to 60.

The plot $\mathbf{180}_3$ is for an antenna element 12 having dimensions $L_p$=3.8 mm and $w_p$=1.0 mm, and, from top to bottom of the plot, the curves each represent a respective size N of the iris 46 for values of N from 28 to 60.

The plot $\mathbf{180}_4$ is for an antenna element 12 having dimensions $L_p$=3.8 mm and $w_p$=1.1 mm, and, from top to bottom of the plot, the curves each represent a respective size N of the iris 46 for values of N from 28 to 60.

The plot $\mathbf{180}_5$ is for an antenna element 12 having dimensions $L_p$=3.8 mm and $w_p$=1.2 mm, and, from top to bottom of the plot, the curves each represent a respective size N of the iris 46 for values of N from 28 to 60.

The plot $\mathbf{180}_6$ is for an antenna element 12 having dimensions $L_p$=3.8 mm and $w_p$=1.3 mm, and, from top to bottom of the plot, the curves each represent a respective size N of the iris 46 for values of N from 28 to 60.

And the plot $\mathbf{180}_7$ is for an antenna element 12 having dimensions $L_p$=3.8 mm and $w_p$=1.4 mm, and, from top to bottom of the plot, the curves each represent a respective size N of the iris 46 for values of N from 28 to 60.

Still referring to FIG. 19, alternate embodiments are contemplated. For example, N size values for the irises 46 are contemplated outside of the range N=28 to N=60, and also non-integer values of N are contemplated both inside and outside of the range N=28 to N=60. Furthermore, values for the width $w_p$ of the antenna elements 12 outside of the range 0.8 mm-1.4 mm are contemplated, and also additional values of $w_p$ within the range 0.8 mm-1.4 mm (i.e., values other than 0.8 mm, 0.9 mm, 1.0 mm, 1.1 mm, 1.2 mm, 1.3 mm, and 1.4 mm) are contemplated. Moreover, values for $L_p$ higher and lower than 3.8 mm are contemplated.

Figure 20:
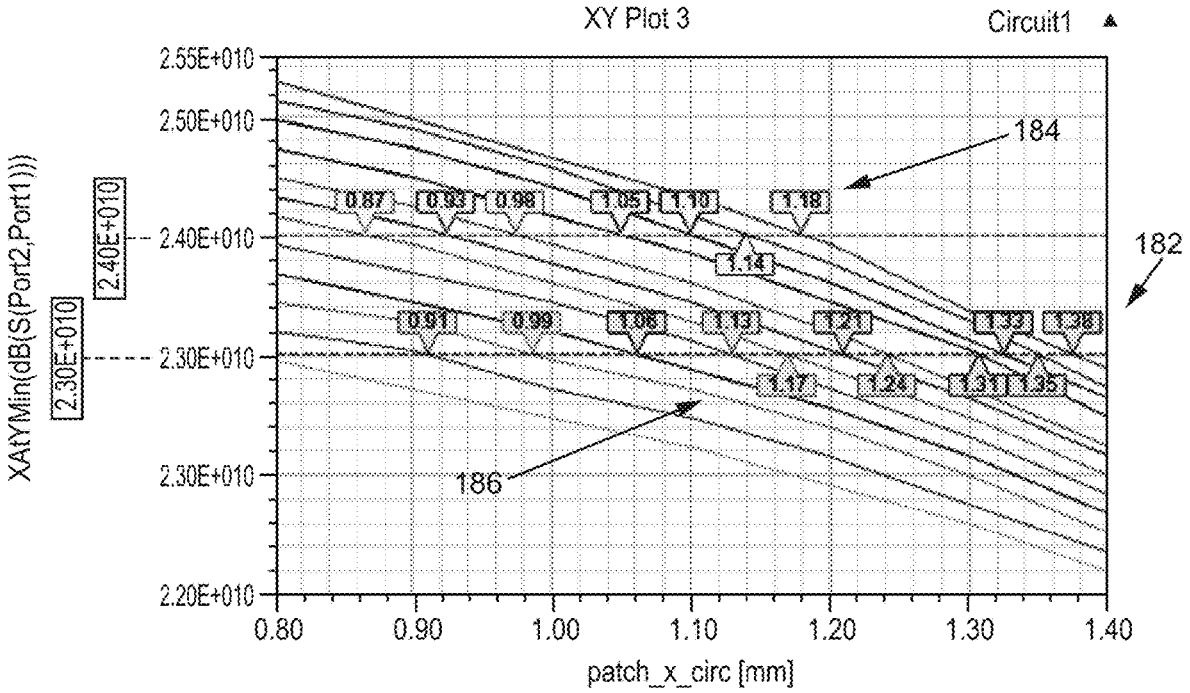
FIG. 20 is a plot showing the resonant frequencies of different-sized pairs of an antenna element and an iris versus antenna-element size, according to an embodiment.

FIG. 20 is a plot 182 with resonant frequency plotted along the y-axis, the width $w_p$ of the antenna element 12 plotted along the x-axis, and with curves representing, from top to bottom, N≈28 to 60 (only some of these curves included in FIG. 20), according to an embodiment.

The top set of values 184 are the values of $w_p$ that yield a combination of an antenna element 12, diode 36, and underlying region 48 having a resonant frequency of 24 GHz for an iris having the sizes represented by N of the curves that intersect the $w_p$ values 184 at 24 GHz. For example, for N≈41, $w_p$=0.87 mm yields a resonant frequency of 24 GHz for the combination of the antenna element 12, diode 36, and underlying region 48.

And the bottom set of values 186 are the values of $w_p$ needed to yield a combination of an antenna element 12, diode 36, and underlying region 48 having a resonant frequency of 23 GHz for an iris having the sizes represented by N of the curves that intersect the $w_p$ values 186 at 23 GHz. For example, for N 54, $w_p$=0.91 mm yields a resonant frequency of 23 GHz for the combination of the antenna element 12, diode 36, and underlying region 48.

Figure 21:
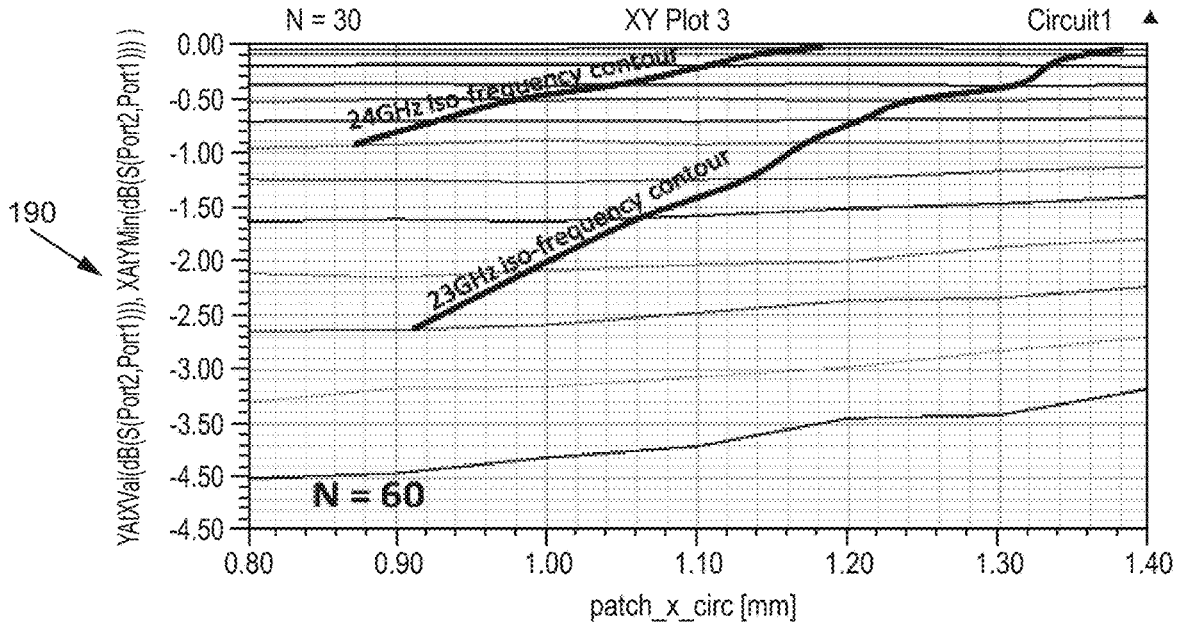
FIG. 21 is a plot showing the signal-coupling levels of different-sized pairs of an antenna element and an iris versus antenna-element size, and including constant-resonant-frequency curves, according to an embodiment.

FIG. 21 is a plot 190 with (P−a) dB plotted along the y-axis, the width $w_p$ of the antenna element 12 plotted along the x-axis, with constant-resonant-frequency contours representing respective resonant frequencies of the combination of the antenna element 12, diode 36, and underlying region 48, and with curves representing, from the top such curve to the bottom such curve, N=30 to N=60, and where $L_P$=3.8 mm for all values of $w_p$, according to an embodiment.

For example, if a designer selects an N value that provides a power coupling of (P−a)=−1.50 dB and the frequency of the designed-for row-reference signal is 23 GHz, then he/she selects $w_p$≈1.08 mm.

Similarly, if a designer selects an N value that provides a coupling power of (P−a)=−0.50 dB and the frequency of the designed-for row-reference signal is 24 GHz, then he/she selects $w_p$≈0.08 mm.

Referring to FIGS. 17-21, to design the sizes of the antenna elements 12 and the irises 48 in a row 14 of antenna units 70 such that each activated antenna element in the row radiates approximately the same power, a designer would use a computer to implement the following steps.

1) Determine the attenuation profile/response of the waveguide 26 along its length in the direction of propagation for a row-reference signal having a particular frequency.

2) Determine, for each antenna unit 70, the power (P−a) dB of the row-reference signal at the location of the antenna unit, where a is the power that the respective iris 46 is to couple to the antenna element 12 so that all of the activated antenna elements in the row 14 radiate approximately the same power level.

3) Determine, for each antenna unit 70, the size of the respective iris 46 needed to couple, from the row-reference signal, the previously determined fraction of power a dB for the antenna unit.

4) Determine, for each antenna unit 70, the size (e.g., length $L_p$, width $w_p$) of the antenna element 12 needed to render the resonant frequency of the combination of the activated antenna element, diode 36, and underlying region 48 approximately equal to the frequency of the row-reference signal.

The antenna structure formed according to the above-described steps (1)-(4) also cause the powers of the receive signal components from the antenna units 70 during a receive mode to be approximately equal at the input/output port (e.g., the input/output port 16 of FIG. 16) of the waveguide 26. For example, referring to FIG. 18, at the input/output port of the waveguide 26, the power of the receive signal component generated by the antenna element 12 of the rightmost antenna unit 70 is approximately the same as the power of the receive signal component generated by the antenna element of the leftmost antenna unit.

Still referring to FIGS. 17-21, alternate embodiments are contemplated. For example, the lengths $L_p$ of the antenna elements 12 in a row 14 can be changed (e.g., reduced) from the front end 28 to the back end 30 of the waveguide 26 along with the widths $w_p$; or the widths $w_p$ can remain constant. Furthermore, instead of enlarging two dimensions $L_i$ and $w_i$ of the irises 46 from the front end 28 to the back end 30 of the waveguide 26, a designer can choose to enlarge only one of these dimensions. And one of the dimensions $L_p$ and $w_p$ can be increased, and one of the dimensions $L_i$ and $w_i$, can be reduced, from the front end 28 to the back end 30 of the waveguide 26 as long as the areas of the antenna elements 12 are decreasing, and the areas of the irises 46 are increasing from the front end to the back end of the waveguide. Furthermore, alternate embodiments described elsewhere in conjunction with FIGS. 1-16 and 22-24 may apply to the antenna 112 of FIGS. 17-18 and referenced in conjunction with FIGS. 19-21.

As described above in conjunction with FIGS. 17-21, the size of each antenna element 12 in a row 14 is chosen to set the resonant frequency of the combination of the antenna element, diode 36, and underlying region 48 to approximately the frequency of the row-reference signal so that the combination imparts little or no phase shift to the iris signal from the corresponding iris 46.

But each iris 48 generates a respective iris signal having a respective phase shift relative to the row-reference signal at the location of the iris. Each iris 48 can be modeled as an inductance that causes the phase of the iris signal to lag the phase of the row-reference signal, where the amount of the phase lag depends, e.g., on the size of the iris.

Because, as described above in conjunction with FIGS. 17-21, a designer selects the size of the iris 48 at a particular location along the row 14 of antenna units 70 such that the iris couples a desired fraction a dB of the power P dB of the row-reference signal to the corresponding antenna element 12, the designer is often "stuck" with the respective phase shift imparted by each iris.

Figure 22:
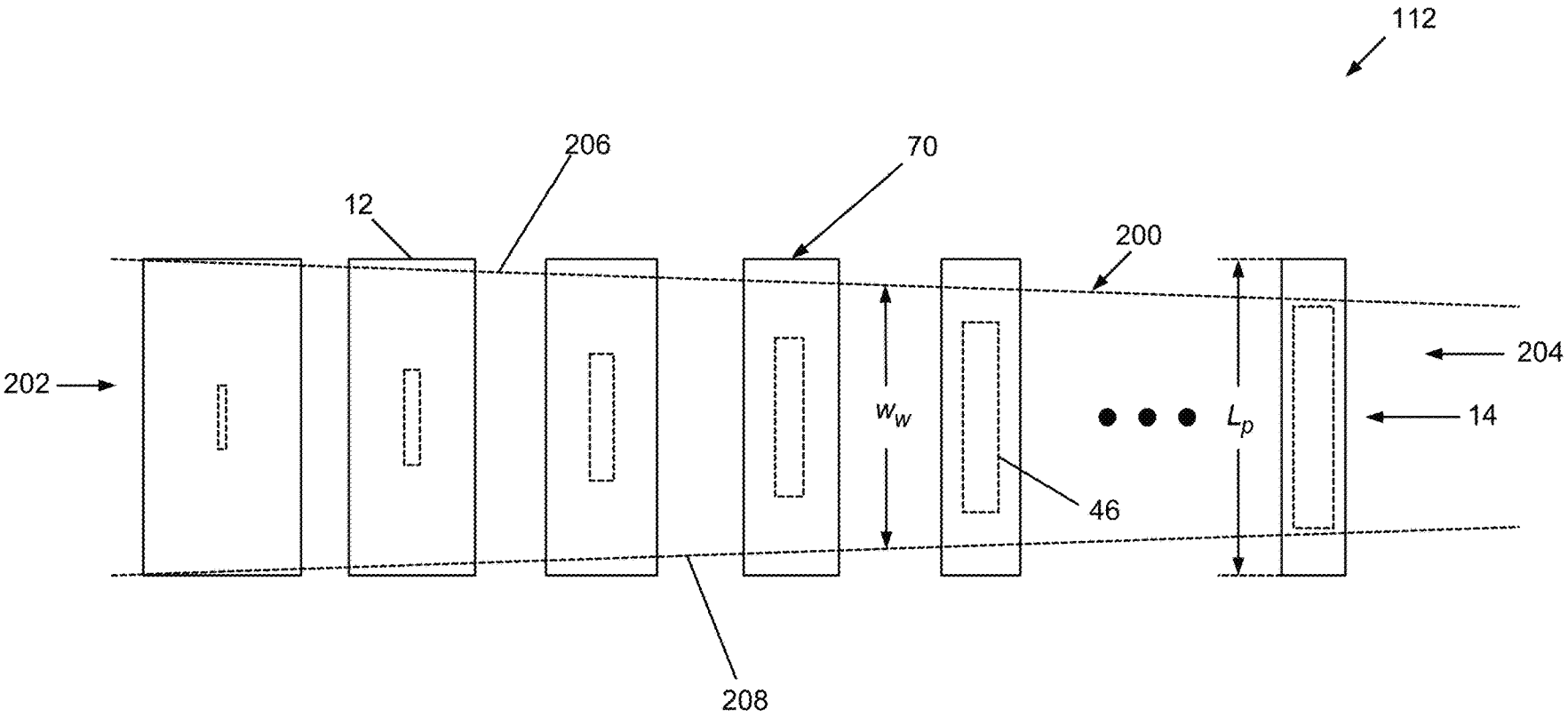
FIG. 22 is a diagram, in plan view, of an antenna including at least one row of antenna units disposed over a waveguide tapered to control the phase shifts of a row-reference wave at respective locations along the waveguide, according to an embodiment.

FIG. 22 is a diagram, in plan view, of the antenna 112 including a row 14 of antenna units 70 and a tapered waveguide 200, which allows a designer some control of the phases of the iris signals independent of the sizes of the irises 46, according to an embodiment. Although one row 14 and one waveguide 200 are shown in FIG. 22, it is understood that the antenna 112 can include multiple similar rows and corresponding similar waveguides.

It is known that the width $w_w$ of a waveguide at any point along the waveguide affects the phase, at that point, of a signal propagating within the waveguide.

Therefore, by changing the width $w_w$ of the waveguide 200 from a front end 202 of the waveguide to a back end 204 of the waveguide (e.g., by making the width $w_w$ a function of location along the waveguide), a designer can cause the iris signal radiated by any particular iris 46 to have, relative to any other arbitrary iris signal, a desired phase that is different from the relative phase that the iris signal would have if the waveguide 200 had a constant width. That is, by purposefully selecting the width profile $w_w$ of the waveguide 200, the designer is no longer "stuck" with the phase shift that an iris 46 effectively imparts to the row-reference signal. Such phase control of the iris signals can allow the designer to reduce the amplitudes of unwanted side lobes in the radiation patterns generated by the antenna 112.

For example, as shown in FIG. 22, the side walls 206 and 208 (which can be formed from vias as described above in conjunction with FIGS. 1-3 and 16) of the waveguide 200 can be tapered inward from the front end 202 to the back end 204 so as to impart desired phases to the iris signals generated by the irises 46.

Therefore, determining, with a computer, the width profile $w_w$ of the waveguide 200 to provide the desired phases to the iris signals (the phase of an iris signal can be determined relative to the phase the row-reference signal at the location of the iris, or relative to the phase(s) of one or more other iris signals) can be added as step S) to the design process described above in conjunction with FIGS. 17-21.

Still referring to FIG. 22, alternate embodiments are contemplated. For example, the change in width profile $w_w$ of the waveguide 200 can be other than a continuous inward taper. For example, the width profile $w_w$ of the waveguide 200 can be tapered outward, and can have a stepped/quantized taper instead of a smooth taper. Furthermore, the height profile of the waveguide 200 can be tapered instead of, or in addition to, the width profile $w_w$ of the waveguide. Moreover, if the lengths $L_p$ of the antenna elements 12 are sized to follow the taper of the waveguide 200, then the walls 206 and 208 of the waveguide can be formed from the DC bias vias 34 and the compensation bias vias 74 as described above in conjunction with FIG. 16. In addition, instead of adjusting iris size for power-coupling control and adjusting waveguide width for phase-shift control, a designer can adjust the waveguide width for power-coupling control and can adjust the iris size for phase-shift control. Furthermore, alternate embodiments described elsewhere in conjunction with FIGS. 1-21 and 23-24 may apply to the antenna 112 of FIG. 22.

Figure 23:
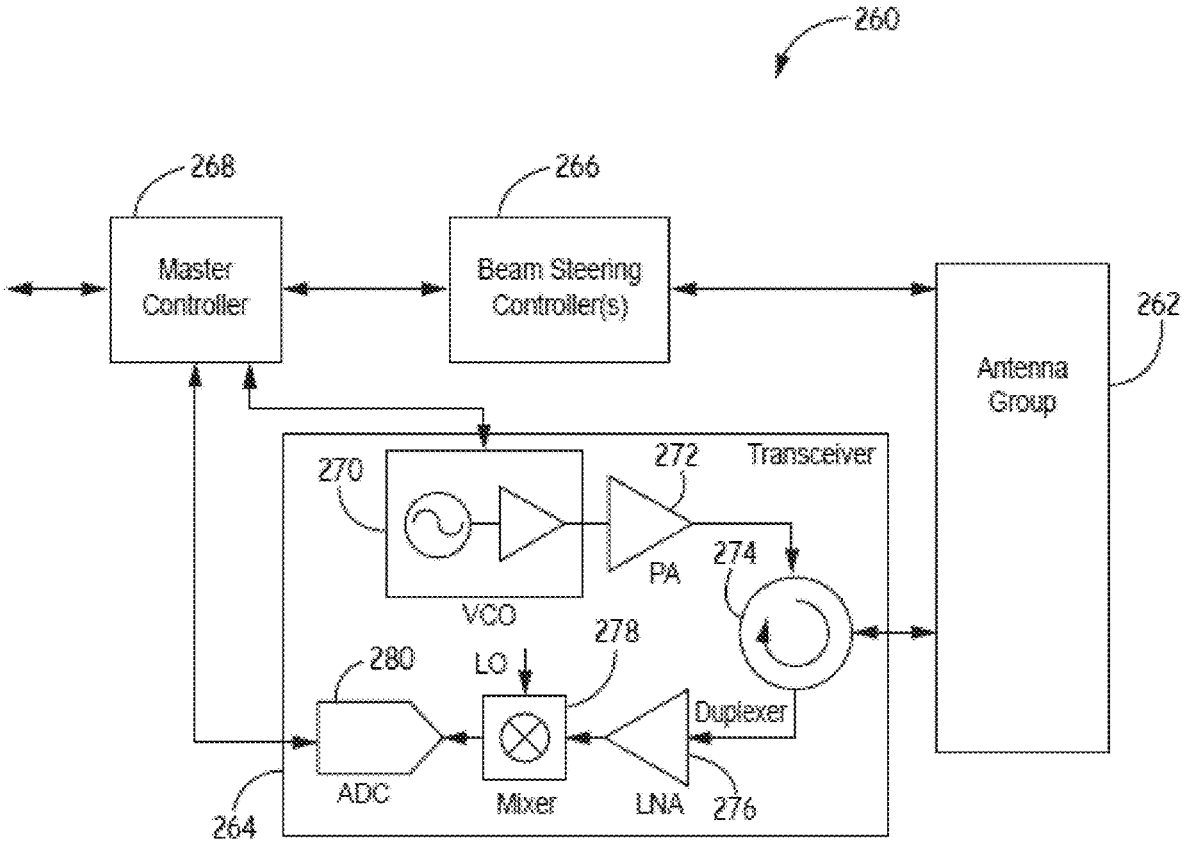
FIG. 23 is a diagram of a radar subsystem that includes at least one antenna having at least one feature described in conjunction with FIGS. 8-22, according to an embodiment.

FIG. 23 is a block diagram of a radar subsystem 260, which includes an antenna group 262 having one or more of the antennas 112 described above in conjunction with FIGS. 4-22, according to an embodiment.

In addition to the antenna group 262, the radar subsystem 260 includes a transceiver 264, a beam-steering controller 266, and a master controller 268.

The transceiver 264 includes a voltage-controlled oscillator (VCO) 270, a preamplifier (PA) 272, a duplexer 274, a low-noise amplifier (LNA) 276, a mixer 278, and an analog-to-digital converter (ADC) 280. The VCO 270 is configured to generate a reference signal having a frequency $f_0=c/\lambda_0$, which is the frequency for which at least one of the antennas of the antenna group 262 is designed. The PA 272 is configured to amplify the VCO signal, and the duplexer 274 is configured to couple the reference signal to the antennas of the antenna group 262 via one or more signal feeders (not shown in FIG. 24) such as the coupler 18 of FIG. 16. One or both of the duplexer 274 and antenna group 262 can include one or more of the signal feeders. The duplexer 274 is also configured to receive signals from the antennas of the antenna group 262, and to provide these received signals to the LNA 276, which is configured to amplify these received signals. The mixer 278 is configured to shift the frequencies of the amplified received signals down to a base band, and the ADC 280 is configured to convert the down-shifted analog signals to digital signals for processing by the master controller 268.

The beam-steering controller 266 is configured to steer the beams (both transmitting and receiving beams) generated by the one or more antennas of the antenna group 262 by generating the bias and neutral control signals to the bias lines 32 of the antenna units 70 (see, e.g., FIGS. 8 and 18) as a function of time and main-beam position. By appropriately generating the control signals, the beam-steering controller 266 is configured to selectively activate and deactivate the antenna elements 12 of the antenna units 70 according to selected spatial and temporal patterns. And if the one or more signal feeders (not shown in FIG. 23) are dynamically configurable to shift the phase or to alter the amplitude of a fed signal, then the beam-steering controller 266 also is configured to control the one or more signal feeders with one or more feeder control signals.

The master controller 268 is configured to control the transceiver 264 and the beam-steering controller 266, and to analyze the digital signals from the ADC 280. For example, assuming that the one or more antennas of the antenna group 262 are designed to operate at frequencies in a range centered about $f_0$, the master controller 268 is configured to adjust the frequency of the signal generated by the VCO 270 for, e.g., environmental conditions such as weather, the average number of objects in the range of the one or more antennas of the antenna assembly, and the average distance of the objects from the one or more antennas, and to conform the signal to spectrum regulations. Furthermore, the master controller 268 is configured to analyze the signals from the ADC 280 to, e.g., identify a detected object, and to determine what action, if any, that a system including, or coupled to, the radar subsystem 260 should take. For example, if the system is a self-driving vehicle or a self-directed drone, then the master controller 268 is configured to determine what action (e.g., braking, swerving), if any, the vehicle should take in response to the detected object.

Operation of the radar subsystem 270 is described below, according to an embodiment. Any of the system components, such as the master controller 268, can store in a memory, and execute, software/program instructions to perform the below-described actions. Alternatively any of the system components, such as the system controller 268, can store, in a memory, firmware or other configuration data that, when loaded into configuration circuitry, configures one or more of the system components to perform the below-described actions. Or any of the system components, such as the master controller 268, can be hardwired to perform the below-described actions.

The master controller 268 generates a control voltage that causes the VCO 270 to generate a reference signal at a frequency within a frequency range centered about $f_0$. For example, $f_0$ can be in the range of approximately 5 Gigahertz (GHz)-100 GHz.

The VCO 270 generates the signal, and the PA 272 amplifies the signal and provides the amplified signal to the duplexer 274.

The duplexer 274 can further amplify the signal, and couples the amplified signal to the one or more antennas of the antenna group 262.

While the duplexer 274 is coupling the signal to the one or more antennas of the antenna group 262, the beam-steering controller 266, in response to the master controller 268, is generating bias and neutral control signals to the antenna units 70 (see, e.g., FIGS. 8 and 17) of the one or more antennas, and, if one or more dynamic signal feeders are present, the beam-steering controller also is generating control signals to these feeders. These control signals cause the one or more antennas to generate and to steer one or more main signal-transmission beams. The bias and neutral control signals cause the one or more main signal-transmission beams to have desired characteristics, and also cause the side lobes to have desired characteristics such as suitable total side-lobe power and a suitable side-lobe level (e.g., between the smallest main signal-transmission beam and the largest side lobe).

Then, the master controller 268 causes the VCO 270 to cease generating the reference signal.

Next, while the VCO 270 is generating no reference signal, the beam-steering controller 266, in response to the master controller 268, generates control signals to the antenna units 70 (see, e.g., FIGS. 8 and 17) of the one or more antennas, and, if one or more dynamic signal feeders are present, the beam-steering controller is generating control signals to these feeders. These control signals cause the one or more antennas to generate and to steer one or more main signal-receive beams. The control signals cause the one or more main signal-receive beams to have desired characteristics, and also cause the side lobes to have desired characteristics such as suitable total side-lobe power and a suitable side-lobe level. Furthermore, the beam-steering controller 266 can generate the same sequence of control signals for steering the one or more main signal-receive beams as it does for steering the one or more main signal-transmit beams.

Then, the duplexer 274 couples signals received by the one or more antennas of the antenna subassembly 262 to the LNA 276.

Next, the LNA 272 amplifies the received signals.

Then, the mixer 278 down-converts the amplified received signals from a frequency, e.g., at or near $f_0$, to a baseband frequency.

Next, the ADC 280 converts the analog down-converted signals to digital signals.

Then, the master system controller 268 analyzes the digital signals to obtain information from the signals and to determine what, if anything, should be done in response to the information obtained from the signals.

The master system controller 268 can repeat the above cycle one or more times.

Still referring to FIG. 23, alternate embodiments of the radar subsystem 260 are contemplated. For example, the radar subsystem 260 can include one or more additional components not described above, and can omit one or more of the above-described components. Furthermore, alternate embodiments described elsewhere in conjunction with FIGS. 1-22 and 24 may apply to the radar subsystem 260 of FIG. 23.

Figure 24:
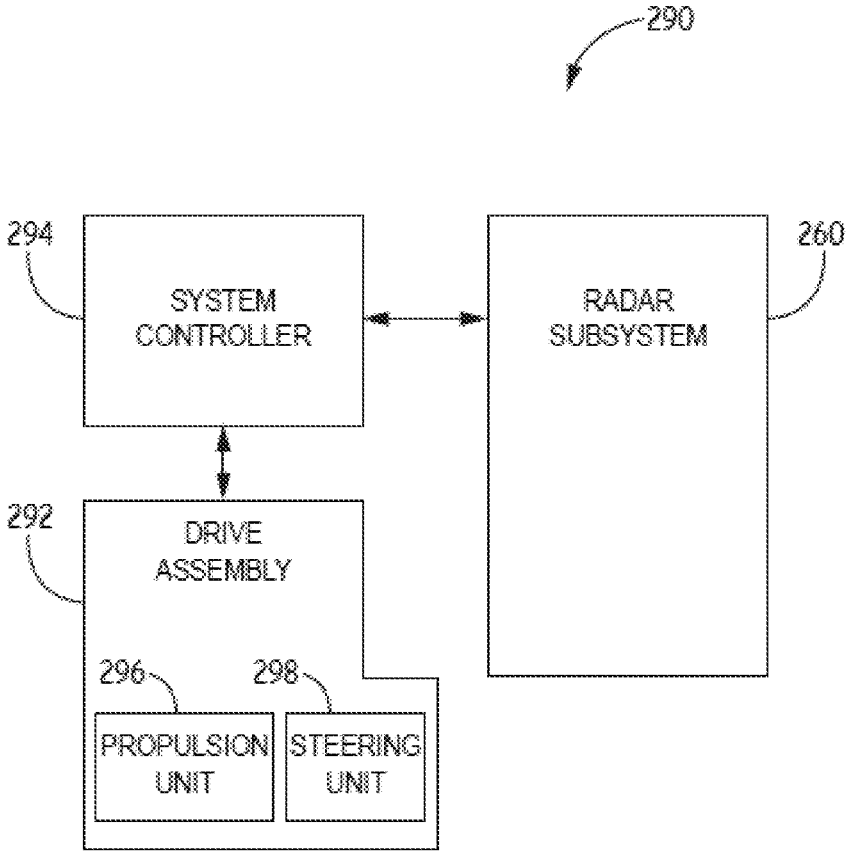
FIG. 24 is a diagram of a system that includes the radar subsystem of FIG. 23, according to an embodiment.

FIG. 24 is a block diagram of a system, such as a vehicle system 290, which includes the radar subsystem 260 of FIG. 23, according to an embodiment. For example, the vehicle system 290 can be an unmanned aerial vehicle (UAV) such as a drone, or a self-driving car.

In addition to the radar subsystem 260, the vehicle system 290 includes a drive assembly 292 and a system controller 294.

The drive assembly 292 includes a propulsion unit 296, such as an engine or motor, and a steering unit 298, such as a rudder, flaperon, pitch control, or yaw control (for, e.g., an UAV or drone), or a steering wheel linked to steerable wheels (for, e.g., a self-driving car).

The system controller 294 is configured to control, and to receive information from, the radar subsystem 260 and the drive assembly 292. For example, the system controller 294 can be configured to receive locations, sizes, and speeds of nearby objects from the radar subsystem 260, and to receive the speed and traveling direction of the vehicle system 290.

Operation of the vehicle system 290 is described below, according to an embodiment. Any of the system components, such as the system controller 294, can store in a memory, and can execute, software/program instructions to perform the below-described actions. Alternatively any of the system components, such as the system controller 294, can store, in a memory, firmware or other configuration data that, when loaded into configuration circuitry, configures one or more of the system components to perform the below-described actions. Or any of the system components, such as the system controller 294, can be circuitry hardwired to perform the below-described actions.

The system controller 294 activates the radar subsystem 260, which, as described above in conjunction with FIG. 23, provides to the system controller information regarding one or more objects in the vicinity of the vehicle system 290. For example, if the vehicle system 290 is an UAV or a drone, then the radar subsystem can provide information regarding one or more objects (e.g., birds, aircraft, and other UAVs/drones), in the flight path to the front, sides, and rear of the UAV/drone. Alternatively, if the vehicle system 290 is a self-driving car, then the radar subsystem 260 can provide information regarding one or more objects (e.g., other vehicles, debris, pedestrians, bicyclists) in the roadway to the front, sides, and rear of the vehicle system.

In response to the object information from the radar subsystem 260, the system controller 294 determines what action, if any, the vehicle system 290 should take in response to the object information. Alternatively, the master controller 268 (FIG. 23) of the radar subsystem can make this determination and provide it to the system controller 294.

Next, if the system controller 294 (or master controller 268 of FIG. 23) determined that an action should be taken, then the system controller causes the drive assembly 292 to take the determined action. For example, if the system controller 294 or master controller 268 determined that a UAV system 290 is closing on an object in front of the UAV system, then the system controller 294 can control the propulsion unit 296 to reduce air speed. Or, if the system controller 294 or master controller 268 determined that an object in front of a self-driving system 290 is slowing down, then the system controller 294 can control the propulsion unit 296 to reduce engine speed and to apply a brake. Or if the system controller 294 or master controller 268 determined that evasive action is needed to avoid an object (e.g., another UAV/drone, a bird, a child who ran in front of the vehicle system 290) in front of the vehicle system, then the system controller 294 can control the propulsion unit 296 to reduce engine speed and, for a self-driving vehicle, to apply a brake, and can control the steering unit 298 to maneuver the vehicle system away from or around the object.

Still referring to FIG. 24, alternate embodiments of the vehicle system 290 are contemplated. For example, the vehicle system 290 can include one or more additional components not described above, and can omit one or more of the above-described components. Furthermore, the vehicle system 290 can be a vehicle system other than a UAV, drone, or self-driving car. Other examples of the vehicle system 290 include a watercraft, a motor cycle, a car that is not self-driving, and a spacecraft. Moreover, a system including the radar subsystem 260 can be other than a vehicle system. Furthermore, alternate embodiments described elsewhere in conjunction with FIGS. 1-23 may apply to the vehicle system 290 of FIG. 24.

From the foregoing it will be appreciated that, although specific embodiments have been described herein for purposes of illustration, various modifications may be made without deviating from the spirit and scope of the disclosure. Furthermore, where an alternative is disclosed for a particular embodiment, this alternative may also apply to other embodiments even if not specifically stated. In addition, any described component or operation may be implemented/performed in hardware, software, firmware (or other configuration data such as a bit stream), or a combination of any two or more of hardware, software, and firmware (or other configuration data). Furthermore, one or more components of a described apparatus or system may have been omitted from the description for clarity or another reason. Moreover, one or more components of a described apparatus or system that have been included in the description may be omitted from the apparatus or system.

Example Embodiments

Example 1 includes an antenna, comprising: a conductive antenna element configured to radiate a first signal having a first polarization; a voltage-bias conductor coupled to a side of the antenna element and configured to radiate a second signal having a second polarization that is different from the first polarization; and a polarization-compensating conductor coupled to an opposite side of the antenna element and configured to radiate third a signal having a third polarization that is approximately the same as the second polarization and that destructively interferes with the second signal.

Example 2 includes the antenna of Example 1 wherein the antenna element includes an electrically-small radiating element such as a patch, a microstrip patch, a slot, or a microstrip dipole.

Example 3 includes the antenna of any of Examples 1-2 wherein: the voltage-bias conductor is configured to conduct a radiating bias voltage that renders the antenna element in a radiating state; and the polarization-compensating conductor is configured to float electrically.

Example 4 includes the antenna of any of Examples 1-3, further comprising: a layer; and wherein the conductive antenna element, the voltage-bias conductor, and the polarization-compensating conductor are disposed in the layer.

Example 5 includes the antenna of any of Examples 1-4, further comprising: a conductive region disposed a distance beneath the antenna element, the voltage-bias conductor, and the polarization-compensation conductor.

Example 6 includes the antenna of any of Examples 1-5, further comprising: wherein the first signal has a wavelength; and a conductive region disposed a distance of approximately one-fourth the wavelength beneath the antenna element, the voltage-bias conductor, and the polarization-compensation conductor.

Example 7 includes an antenna, comprising: a conductive antenna element; a conductive signal-bypass stub disposed below the conductive antenna element; and a conductive voltage-bias via coupled to the antenna element and to the signal-bypass stub.

Example 8 includes the antenna of Example 7, further comprising: a transmission medium disposed below the antenna element; and wherein the signal-bypass stub is disposed within the transmission medium.

Example 9 includes an antenna, comprising: a conductive antenna element; a first conductive region disposed below the conductive antenna element; an iris disposed in the first conductive region; a first conductive signal-bypass stub disposed below the first conductive region; a second conductive signal-bypass stub disposed below the first signal-bypass stub; a second conductive region disposed below the second signal-bypass stub; and a conductive voltage-bias via coupled to the antenna element and to the first and second signal-bypass stubs.

Example 10 includes the antenna of Example 9 wherein each of the first and second signal-bypass stubs is tapered inward toward the voltage-bias via.

Example 11 includes the antenna of any of Examples 9-10 wherein the first and second signal-bypass stubs are approximately aligned with one another.

Example 12 includes the antenna of any of Examples 9-11, further comprising: a first insulator region disposed between the antenna element and the first conductive region and having a first thickness; a second insulator region disposed between the first conductive region and the first signal-bypass stub and having a second thickness that is significantly less than the first thickness; a third insulator region disposed between the first and second signal-bypass stubs and having a third thickness that is significantly greater than the second thickness; and a fourth insulator region disposed between the second signal-bypass stub and the second conductive region and having a fourth thickness that is significantly less than the first and third thicknesses.

Example 13 includes the antenna of any of Examples 9-12, further comprising: a first insulator region disposed between the antenna element and the first conductive region and having a first thickness; a second insulator region disposed between the first conductive region and the first signal-bypass stub and having a second thickness that is significantly less than the first thickness; a third insulator region disposed between the first and second signal-bypass stubs and having a third thickness that is approximately the same as the first thickness; and a fourth insulator region disposed between the second signal-bypass stub and the second conductive region and having a fourth thickness that is approximately the same as the second thickness.

Example 14 includes the antenna of any of Examples 9-13, further comprising: a third conductive signal-bypass stub disposed below the first conductive region at approximately a same level as the first signal-bypass stub; a fourth conductive signal-bypass stub disposed below the third conductive signal-bypass stub and approximately at a same level as the second signal-bypass stub; wherein the voltage-bias via is coupled to a first side of the antenna element; and a conductive polarization-compensation via coupled to a second side of the antenna element and to the third and fourth signal-bypass stubs, the second side of the antenna element being opposite to the first side of the antenna element.

Example 15 includes an antenna, comprising: a transmission medium having a characteristic impedance, having an end, and configured to carry a signal having a wavelength; and an impedance-termination structure disposed approximately at the end of the transmission medium, configured to have approximately zero impedance at the wavelength, and configured to couple, to the end of the transmission medium, an impedance structure having approximately the characteristic impedance.

Example 16 includes the antenna of Example 15 wherein: the transmission medium includes a waveguide having a conductive side; and the impedance-termination structure includes a slot disposed in the side of the waveguide approximately at the end of the waveguide, and a conductor having a first portion coupled to the side of the waveguide and approximately parallel to a portion of the slot, and a second portion extending over, and approximately perpendicular to, the portion of the slot and configured for coupling to the impedance structure.

Example 17 includes the antenna of any of Examples 15-16, wherein the impedance structure includes a resistor having approximately the characteristic impedance.

Example 18 includes the antenna of any of Examples 15-17, wherein the impedance structure includes a probe having approximately the characteristic impedance.

Example 19 includes an antenna, comprising: a first row of antenna elements; a first waveguide disposed beneath the first row of antenna elements and including a side formed by a row of spaced-apart conductive vias; a second row of antenna elements; and a second waveguide disposed beneath the second row of antenna elements and including a side formed by the row of the spaced-apart conductive vias.

Example 20 includes an antenna, comprising: a first row of antenna elements; a first waveguide disposed beneath the first row of antenna elements and including a side formed by a row of spaced-apart conductive vias, every other one of the vias electrically coupled to a respective antenna element in the first row; a second row of antenna elements that are offset relative to the first row of antenna elements; and a second waveguide disposed beneath the second row of antenna elements and including a side formed by the row of the spaced-apart conductive vias, every other one of the vias not electrically coupled to an antenna element in the first row electrically coupled to a respective antenna element in the second row.

Example 21 includes the antenna of Example 20, wherein each of the vias coupled to an antenna element in the first row and each of the vias coupled to an antenna element in the second row includes a respective voltage-bias via or a respective polarization-compensation via.

Example 22 includes the antenna of any of Examples 20-21, wherein between each of the vias coupled to respective immediately adjacent antenna elements in the first row there is only one via, which is coupled to an antenna element in the second row.

Example 23 includes the antenna of any of Examples 20-22, wherein between each of the vias coupled to respective immediately adjacent antenna elements in the second row there is only one via, which is coupled to an antenna element in the first row.

Example 24 includes an antenna, comprising: a row of antenna elements; a transmission medium disposed beneath the row of antenna elements and having a receiving end and an opposite end; and coupling structures each configured to couple, to a respective one of the antenna elements, an approximately same power from a signal propagating along the transmission medium from the receiving end to the opposite end.

Example 25 includes the antenna of Example 24 wherein at least one of the antenna elements has a size in a dimension that is different from a size in the dimension of at least one of the other antenna elements.

Example 26 includes the antenna of any of Examples 24-25 wherein at least one of the coupling structures has a size in a dimension that is different from a size in the dimension of at least one of the other coupling structures.

Example 27 includes the antenna of any of Examples 24-26 wherein sizes of the antenna elements in at least one dimension change monotonically from one end of the row of antenna elements to another end of the row of antenna elements.

Example 28 includes the antenna of any of Examples 24-27 wherein sizes of the coupling structures in at least one dimension change monotonically from one end of the row of antenna elements to another end of the row of antenna elements.

Example 29 includes the antenna of any of Examples 24-28 wherein sizes of the antenna elements in at least one dimension decrease from an end of the row of antenna elements corresponding to the receiving end of the transmission medium to another end of the row of antenna elements corresponding to the opposite end of the transmission medium.

Example 30 includes the antenna of any of Examples 24-29 wherein widths of the antenna elements decrease from an end of the row of antenna elements corresponding to the receiving end of the transmission medium to another end of the row of antenna elements corresponding to the opposite end of the transmission medium.

Example 31 includes the antenna of any of Examples 24-30 wherein sizes of the coupling structures in at least one dimension increase from an end of the row of antenna elements corresponding to the receiving end of the transmission medium to another end of the row of antenna elements corresponding to the opposite end of the transmission medium.

Example 32 includes the antenna of any of Examples 24-31 wherein: the transmission medium includes a waveguide having a conductive ceiling; and each of the coupling structures includes a respective iris formed in the ceiling beneath a respective one of the antenna elements.

Example 33 includes the antenna of Example 32 wherein: sizes of the antenna elements in at least one dimension decrease from an end of the row of antenna elements corresponding to the receiving end of the transmission medium to another end of the row of antenna elements corresponding to the opposite end of the transmission medium; and sizes of the irises in at least one dimension increase from an end of the row of antenna elements corresponding to the receiving end of the transmission medium to another end of the row of antenna elements corresponding to the opposite end of the transmission medium.

Example 34 includes the antenna of any of Examples 32-33 wherein: widths of the antenna elements decrease from an end of the row of antenna elements corresponding to the receiving end of the transmission medium to another end of the row of antenna elements corresponding to the opposite end of the transmission medium; and widths and lengths of the irises increase from an end of the row of antenna elements corresponding to the receiving end of the transmission medium to another end of the row of antenna elements corresponding to the opposite end of the transmission medium.

Example 35 includes the antenna of any of Examples 32-34 wherein: sizes of the irises in at least one dimension change from an end of the row of antenna elements corresponding to the receiving end of the transmission medium to another end of the row of antenna elements corresponding to the opposite end of the transmission medium such that each iris couples, to a respective one of the antenna elements, the approximately same power from the signal propagating along the transmission medium; and sizes of the antenna elements in at least one dimension change from an end of the row of antenna elements corresponding to the receiving end of the transmission medium to another end of the row of antenna elements corresponding to the opposite end of the transmission medium such that each pair of an antenna element and a corresponding coupling structure have approximately a same resonant frequency.

What is claimed is:

1. An antenna, comprising:

a conductive antenna element;

a ground conductor;

a conductive DC-voltage-bias via coupled to the antenna element; and a conductive, resonant signal-bypass stub disposed below the conductive antenna element and configured to couple an RF signal from the DC-voltage-bias via to the ground conductor.

2. The antenna of claim 1, further comprising:

a transmission medium disposed below the antenna element; and wherein the resonant signal-bypass stub is disposed within the transmission medium.

3. The antenna of claim 1, further comprising:

a transmission medium disposed below the antenna element and configured to carry a transmit reference signal to the antenna element; and wherein the resonant signal-bypass stub is disposed within the transmission medium.

4. The antenna of claim 1, further comprising:

a transmission medium disposed below the antenna element and configured to carry a receive reference signal from the antenna element; and wherein the resonant signal-bypass stub is disposed within the transmission medium.

5. The antenna of claim 1, wherein the resonant signal-bypass stub is configured to form, along with an insulator region below the ground conductor, a resonant circuit.

6. The antenna of claim 1, wherein the resonant signal-bypass stub is radially tapered and has a circular-arc end.

7. The antenna of claim 1, further comprising:

a second conductive signal-bypass stub disposed below the conductive, resonant signal-bypass stub;

wherein each of the resonant signal-bypass stub and the second conductive signal-bypass stubs are tapered inward toward the conductive DC-voltage-bias via.

8. The antenna of claim 1, further comprising:

a second conductive signal-bypass stub disposed above the conductive, resonant signal-bypass stub;

wherein each of the resonant signal-bypass stub and the second conductive signal-bypass stubs are tapered inward toward the conductive DC-voltage-bias via.

9. The antenna of claim 1, further comprising:

a waveguide disposed below the antenna element; and wherein the resonant signal-bypass stub is disposed within the waveguide.

10. An antenna, comprising:

a conductive antenna element;

a first conductive region disposed below the conductive antenna element;

an iris disposed in the first conductive region;

a first conductive signal-bypass stub disposed below the first conductive region;

a second conductive signal-bypass stub disposed below the first signal-bypass stub;

a second conductive region disposed below the second signal-bypass stub; and a conductive voltage-bias via coupled to the antenna element and to the first and second signal-bypass stubs and disposed outside of the iris.

11. The antenna of claim 10 wherein each of the first and second signal-bypass stubs is tapered inward toward the voltage-bias via.

12. The antenna of claim 10 wherein the first and second signal-bypass stubs are approximately aligned with one another.

13. The antenna of claim 10, further comprising:

a first insulator region disposed between the antenna element and the first conductive region and having a first thickness;

a second insulator region disposed between the first conductive region and the first signal-bypass stub and having a second thickness that is significantly less than the first thickness;

a third insulator region disposed between the first and second signal-bypass stubs and having a third thickness that is significantly greater than the second thickness; and a fourth insulator region disposed between the second signal-bypass stub and the second conductive region and having a fourth thickness that is significantly less than the first and third thicknesses.

14. The antenna of claim 10, further comprising:

a first insulator region disposed between the antenna element and the first conductive region and having a first thickness;

a second insulator region disposed between the first conductive region and the first signal-bypass stub and having a second thickness that is significantly less than the first thickness;

a third insulator region disposed between the first and second signal-bypass stubs and having a third thickness that is approximately the same as the first thickness; and a fourth insulator region disposed between the second signal-bypass stub and the second conductive region and having a fourth thickness that is approximately the same as the second thickness.

15. An antenna, comprising:

a conductive antenna element;

a first conductive region disposed below the conductive antenna element;

an iris disposed in the first conductive region;

a first conductive signal-bypass stub disposed below the first conductive region;

a second conductive signal-bypass stub disposed below the first signal-bypass stub;

a second conductive region disposed below the second signal-bypass stub;

a conductive voltage-bias via coupled to the antenna element and to the first and second signal-bypass stubs;

a third conductive signal-bypass stub disposed below the first conductive region at approximately a same level as the first signal-bypass stub;

a fourth conductive signal-bypass stub disposed below the third conductive signal-bypass stub and approximately at a same level as the second signal-bypass stub;

wherein the voltage-bias via is coupled to a first side of the antenna element; and a conductive polarization-compensation via coupled to a second side of the antenna element and to the third and fourth signal-bypass stubs, the second side of the antenna element being opposite to the first side of the antenna element.

* * * * *